US010576598B2

(12) United States Patent
Raczuk

(10) Patent No.: US 10,576,598 B2
(45) Date of Patent: Mar. 3, 2020

(54) CONDUIT SURFACE REPAIR TOOL

(71) Applicant: Richard C. Raczuk, Lake Havasu, AZ (US)

(72) Inventor: Richard C. Raczuk, Lake Havasu, AZ (US)

( * ) Notice: Subject to any disclaimer, the term of this patent is extended or adjusted under 35 U.S.C. 154(b) by 10 days.

(21) Appl. No.: 15/925,293

(22) Filed: Mar. 19, 2018

(65) Prior Publication Data

US 2018/0207763 A1 Jul. 26, 2018

Related U.S. Application Data

(63) Continuation-in-part of application No. 14/056,650, filed on Oct. 17, 2013, now Pat. No. 9,943,942.

(60) Provisional application No. 62/596,584, filed on Dec. 8, 2017.

(51) Int. Cl.
*B24B 5/40* (2006.01)
*B24B 41/06* (2012.01)

(52) U.S. Cl.
CPC ..... *B24B 5/40* (2013.01); *B24B 41/06* (2013.01)

(58) Field of Classification Search
CPC ..... B24B 9/007; B24B 5/40; B24B 23/08; B21D 41/021
USPC ..... 451/51, 252, 61, 180, 557, 558, 541; 241/439
See application file for complete search history.

(56) References Cited

U.S. PATENT DOCUMENTS 9,943,942 B2 * 4/2018 Raczuk ..... B24B 9/007
2005/0271764 A1 * 12/2005 McKenzie ..... B21D 41/021 425/392
2012/0167654 A1 * 7/2012 Kenny ..... B21D 19/14 72/318

* cited by examiner

*Primary Examiner* — George B Nguyen
(74) *Attorney, Agent, or Firm* — Taft Stettinius & Hollister

(57) ABSTRACT

The present disclosure is directed to a surfacing tool for repairing a sealing surface on a fitting. The surfacing tool is defined by a tool head and a tool head guide having an internal bore sized to receive the tool head. The tool head is includes a reverse flare working surface positioned at a first end thereof. A threaded element is positioned at one end of the tool head guide to threadingly receive a threaded flare fitting. The tool head being rotatable within the tool head guide while engaging and grinding the sealing surface on the fitting to a desired finish.

27 Claims, 18 Drawing Sheets

CONDUIT SURFACE REPAIR TOOL

TECHNICAL FIELD

The present disclosure relates to an apparatus for repairing a portion of an interface surface of a fluid conduit, and more particularly to a repair tool for grinding, lapping or otherwise finishing flared surfaces of tubes and fittings with a surfacing tool to facilitate fluid tight connections therebetween.

BACKGROUND

Interface portions of fluid conduits such as fittings or connectors and the like can become damaged or worn over time. Sealing surfaces between fluid conduits and connectors sometimes become damaged to the point where a fluid tight seal cannot be maintained. Some prior art repair tools have drawbacks and shortcomings relative to certain applications, therefore a need remains for improvements in this area of technology.

SUMMARY

One embodiment of the present disclosure is a unique apparatus and method for grinding, lapping, smoothing or otherwise forming a finished surface capable of creating a fluid tight connection between conduits. Other embodiments include apparatuses, systems, devices, hardware, methods, and combinations for the same. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
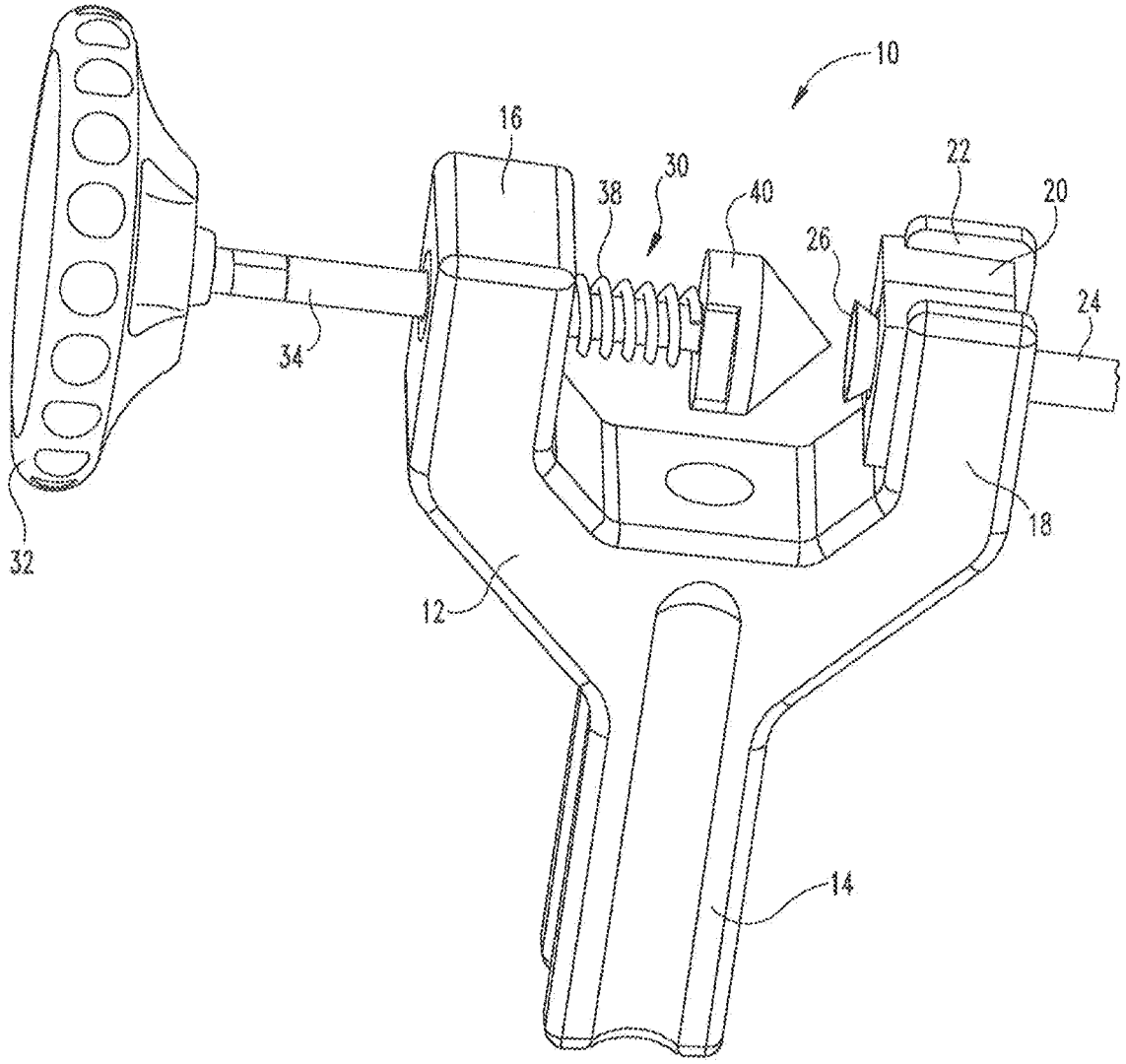
FIG. 1 is a perspective view of a hand operated grinding apparatus.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. It should also be understood that when the term "grinding" is used throughout this disclosure the term is merely used for convenience and should not be construed as limiting the scope of the disclosure. The term "grinding" includes any material removing or finish surfacing techniques such as, but not limited to lapping, polishing, or otherwise smoothing a surface of a work piece such as a flared surface of a fluid fitting to form a fluid tight sealing surface with a coupled fluid conduit.

Referring to FIG. 1, a hand operated grinding apparatus 10 is illustrated therein. The hand operated grinding apparatus 10 can be configured to finish interface surfaces of work pieces or fluid conduits such as a double flare brake line for a vehicle or other applications. In one form, the apparatus 10 is portable and can be used to surface brake lines, tubes and fittings that remain attached to a vehicle. The hand operated grinding apparatus 10 can include a fixture 12 having a base 14 extending to a grinding tool yoke 16 on one side and a work piece yoke 18 on an opposing side of the hand operated grinding apparatus 10. A work piece collet 20 can be releasably engaged with a collet holding portion 22 formed in the work piece yoke 18. The work piece collet 20 can be configured to hold a work piece in a fixed position relative to the work piece yoke 18. In an exemplary embodiment, the work piece is a tube 24 with a flared end 26, however the present disclosure should not be limited to any particular embodiment shown in the drawings. As such, any work piece having a surface that can be finished through a grinding, polishing, lapping or any other surface smoothing technique can be utilized with the present disclosure as described and claimed herein. On the other side, a grinding tool 30 can be operably coupled with the grinding tool yoke 16 of the apparatus 10. The grinding tool 30 can include a hand actuator that is gripable by an operator such as a hand wheel 32 connected to one end of a primary drive grinding tool shaft 34. A grinding head 40 can be connected to the other end of the grinding tool shaft 34. An optional biasing member 38 such as a coil spring or other force generating mechanism can be positioned between the grinding tool yoke 16 and the grinding head 40.

Figure 2:
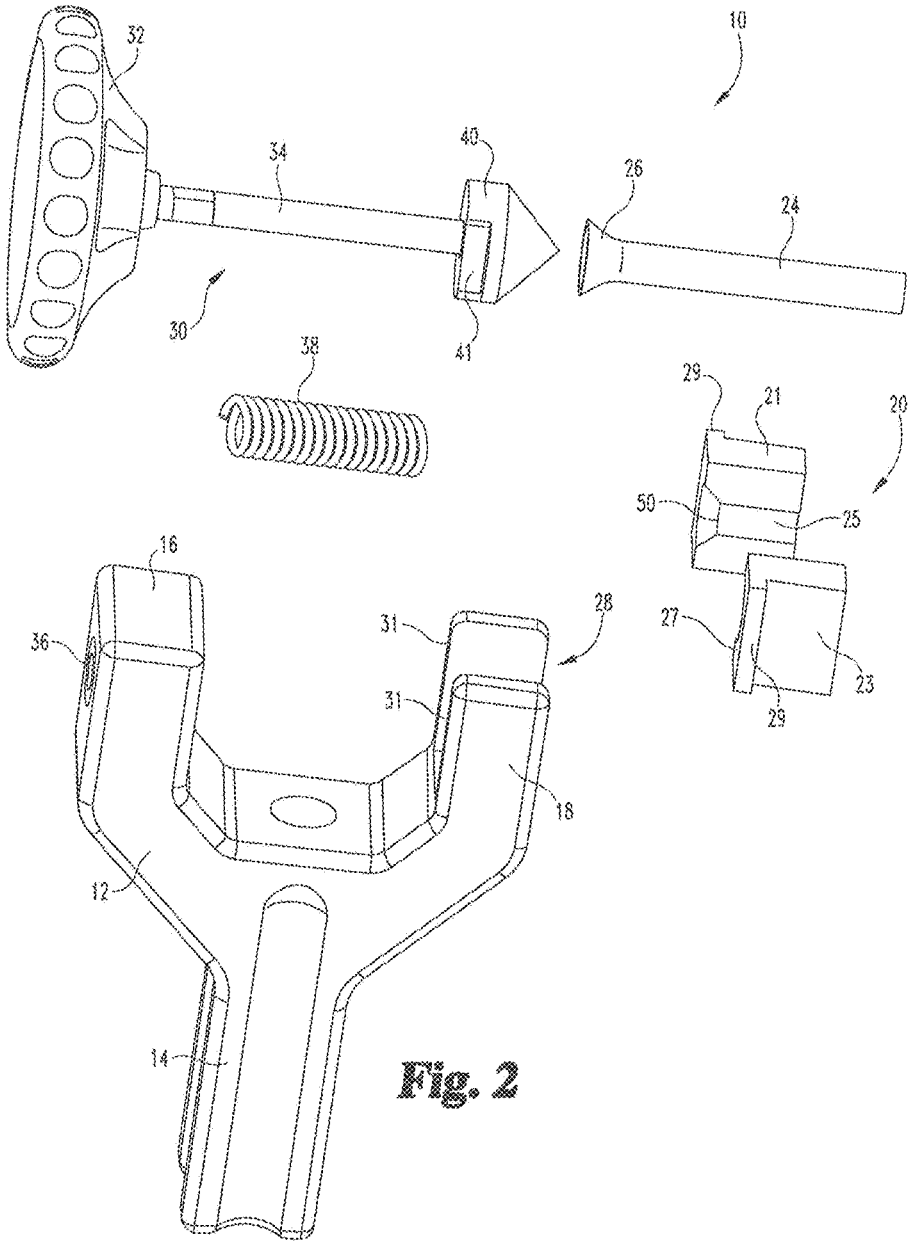
FIG. 2 is an exploded view of the hand operated grinding apparatus of FIG. 1.

Referring now to FIG. 2, the hand operated grinding apparatus 10 is shown in an exploded view to more particularly illustrate the features of the apparatus 10. In one form, the hand operated grinding apparatus 10 is configured to receive the shaft 34 of the grinding tool 30 through an aperture 36 formed in the grinding tool yoke 16. The shaft 34 can be positioned through the aperture 36 and the hand wheel 32 can then be attached to one end thereof through threaded means or other mechanical fastening means as would be known to one skilled in the art. The grinding head 40 can be attached to the shaft 34 of the grinding tool 30 either before or after the shaft 34 is positioned through the aperture 36. The grinding head 40 can be attached to the shaft 34 via threaded means, press fit, welding, or other mechanical techniques. One or more coupling enabling features such as a flat 41 can be formed on the grinding head 40 to facilitate a connection surface for a wrench to engage therewith. Alternatively, the grinding head 40 and grinding tool shaft 34 can be formed as an integral single piece construction though a casting, forging and/or machining processes. In the exemplary drawing, the outer diameter of the grinding head 40 is shown as larger than the outer diameter of the grinding tool shaft 34. However it should be understood that this is for illustrative purposes only and the outer diameter of the grinding head 40 can be the same as or even smaller than that of the shaft 34 in some embodiments. The biasing member 38 can be positioned between the grinding head 40 and the grinding tool yoke 16 in a manner that urges the grinding head 40 toward the work piece yoke 18.

The work piece collet 20 can include internal features 50 that correspond to the size and shape of a work piece such as the flared tube 24 illustrated in this exemplary drawing. The tube 24 can be positioned within the collet 20 and clamped together such that the tube 24 cannot be pulled through the collet 20 when the collet 20 is operationally coupled to the work piece yoke 18. In one form, the collet 20 can be formed of two or more opposing clam shell portions 21, 23 and in another form, the collet 20 can simply be formed as a single one piece construction that permits the work piece to slide through an opening 25 until a protruding feature on the work piece abuts a wall 27 of the collet 20. The collet 20 with the tube 24 inserted therein can be coupled to the work piece yoke 18 by sliding engagement with a channel 28 formed in the work piece yoke 18. The collet 20 can be held in channel 28 through frictional fit or alternatively with threaded fasteners (not shown) or the like. A flange 29 extending from a wall 27 of the collet 20 can abut against a face 31 of the channel 28 when the collet 20 is positioned therein. The force of the grinding tool 30 applied to the work piece and collet 20 during operation will tend to urge the collet 20 into the channel 28 so as to prevent the collet 20 from disengaging from the channel 28 of the work piece yoke 18. Other forms of containment of the collet 20 are contemplated by the present disclosure including, but not limited to threaded fasteners, clips, pins and the like. It should be noted that in some embodiments of the present disclosure that a collet 20 may not be used with the apparatus 10. In such embodiments, the work piece yoke 18 may be formed in such a way as to permit direct engagement with and holding of a work piece to be finished with a grinding tool 30.

Figure 3:
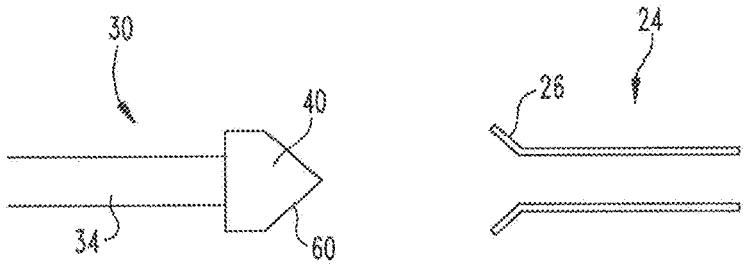
FIG. 3 is a schematic cross-sectional representation of a tube grinding tool and a tube with a flared end.

Referring now to FIG. 3, a schematic representation of a portion of the grinding tool 30 and the flared tube 24 is illustrated therein. The shaft 34 of the grinding tool 30 can include an outer layer of bearing material or a coating such as a solid lubrication coating or an anti-fret coating applied to the external surface thereof to permit sliding and rotating engagement through the aperture 36 of the grinding tool yoke 16 while minimizing wear to the shaft 34. In addition to or in lieu of a bearing or coating material placed on the shaft 34, the aperture 36 of the grinding tool yoke 16 can include a bearing or bushing material such as a pressed in bearing insert or the like. The bearing material can be formed from any material combination as known to those skilled in the art. In one aspect, the bearing material and can include bronze, tin, copper or other combinations of suitable material. The tool head 40 can be formed from a hardened steel, metal alloy, ceramic, or other suitable combinations of materials. The tool head 40 can include a hardened working surface 60 that has a complimentary shape to a surface of a work piece such as the flared end 26 of the tube 24. In the exemplary embodiment the tool head 40 includes a generally conically shaped working surface 60, however in other embodiments a working surface 60 having different shapes is contemplated. The hardened working surface 60 can include material addition such as diamond particles, diamond dust, cubic boron nitride abrasive particles or other abrasive materials having a ceramic or carbon particle base to facilitate a grinding operation. Optionally, dry lubrication material such as graphite can be added to the working surface 60 to promote a dry grinding operation. As described above, the grinding tool shaft 34 and grinding head 40 can be made as separate components and with optional separate material compositions or alternatively can be formed as a single one piece component through casting or forged billet material.

Figure 4:
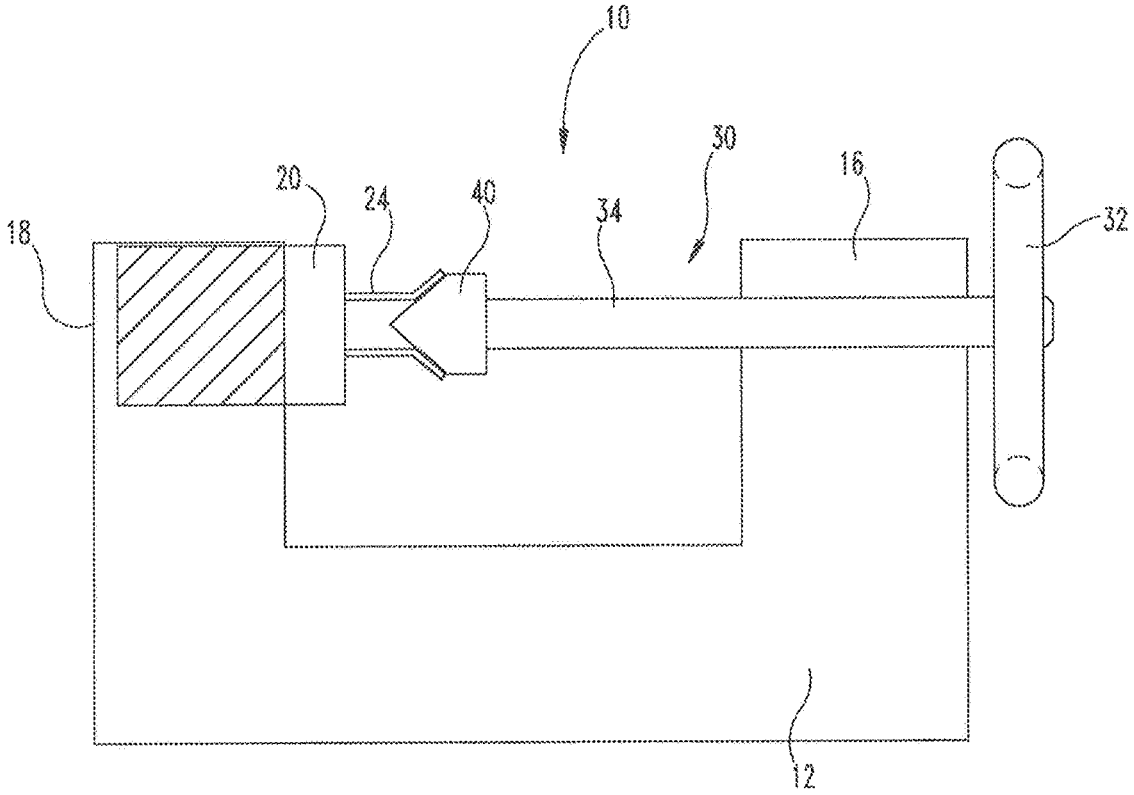
FIG. 4 is a schematic cross-sectional view of the grinding apparatus with a grinding tool engaged with a flared end of a tube.

Referring now to FIG. 4, a hand operated grinding apparatus 10 is shown in a schematic view wherein the grinding tool shaft 34 of the grinding tool 30 is engaged with the grinding yoke 16 and is positioned such that the grinding head 40 is engaged with the flared end 26 of the tube 24. In this position, the hand wheel 32 can be rotated in one direction and/or in alternating rotational directions in order to grind, smooth or otherwise form a desired surface profile for the flared end 26 so that a fluid tight coupling can be achieved between the tube 24 and a fitting or other component.

Figure 5:
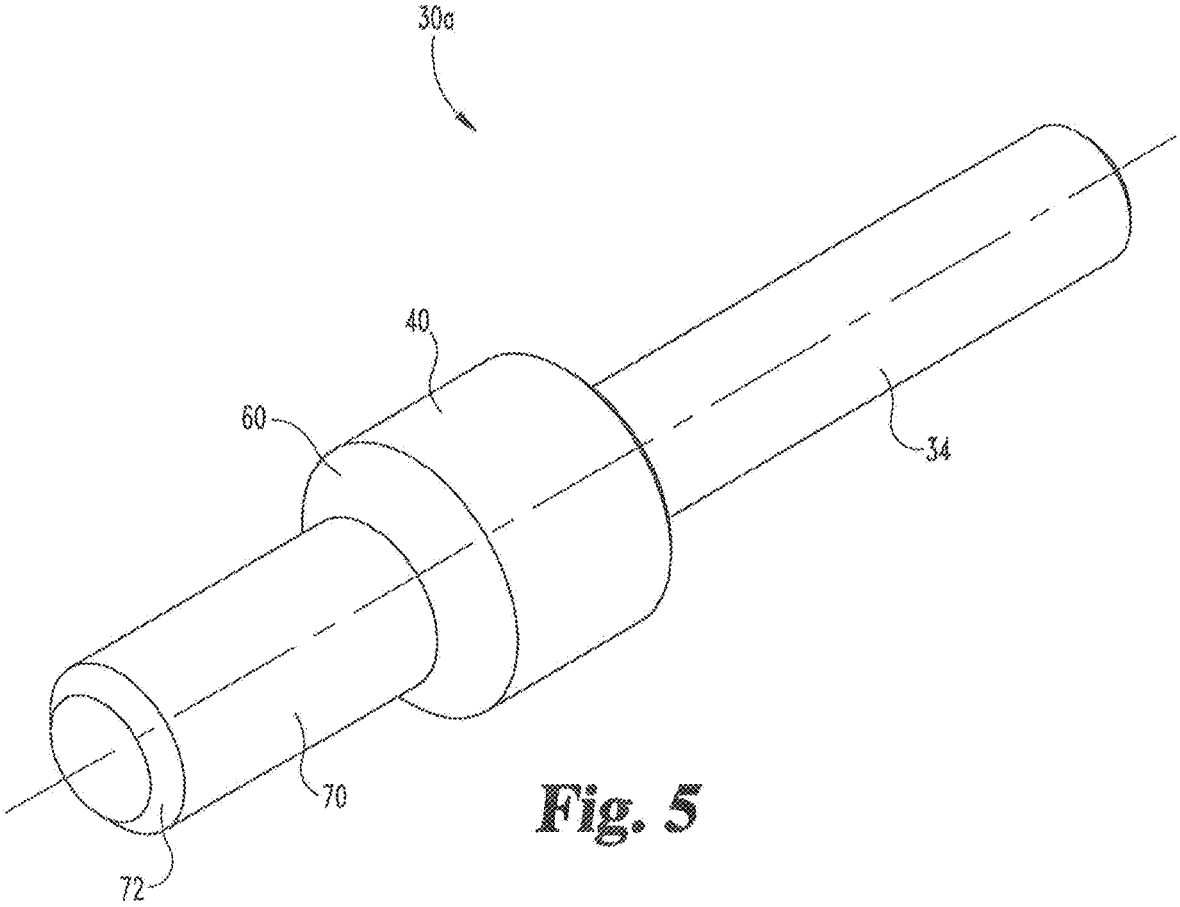
FIG. 5 is a perspective view of an alternate embodiment of a tube grinding tool.

Turning now to FIG. 5, an alternate embodiment of a grinding tool **30*a* is illustrated therein. The alternate grinding tool 30*a* includes a grinding tool shaft 34 connected to a grinding tool head 40 with a working surface 60 similar to the previous grinding tool 30. A centering rod 70 can extend from the grinding tool head 40 in an opposite direction to that of the shaft 34. The centering rod 70 can include a lead-in chamfer 72 or other features to help locate the centering rod 70 within a corresponding tube. The centering rod 70 can help center or align the grinding tool 30*a*** with respect to a tube (not shown) having a surface to be finished.

Figure 6:
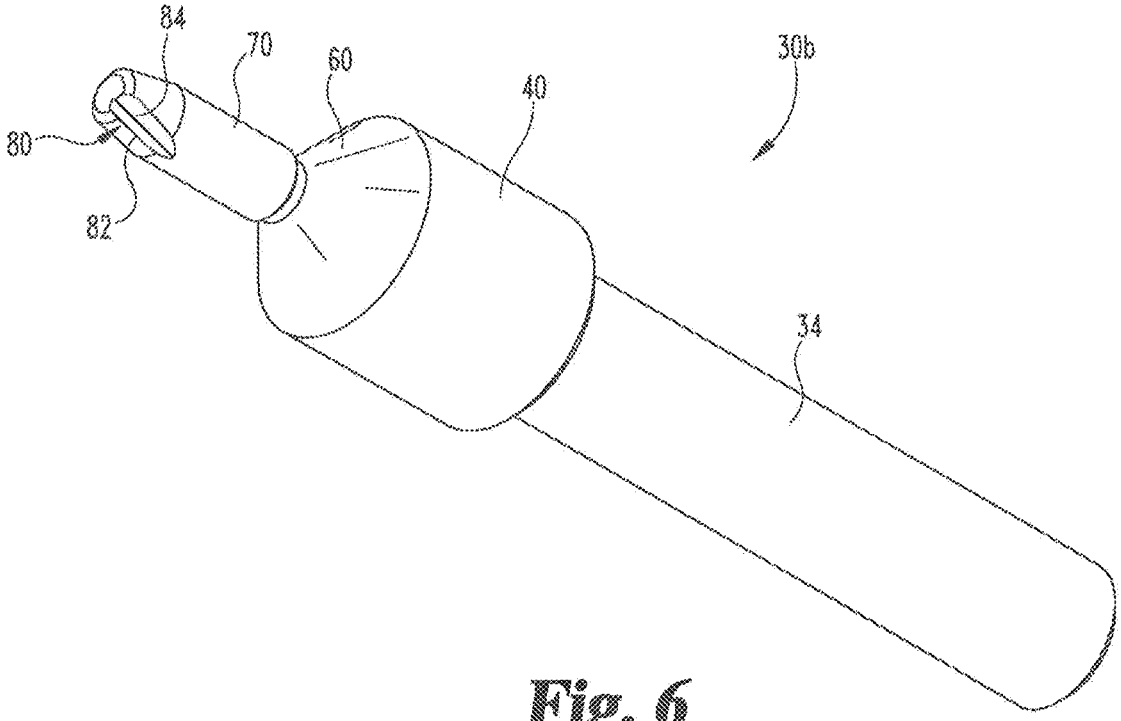
FIG. 6 is a perspective view of yet another embodiment of a tube grinding tool.

Referring now to FIG. 6, yet another embodiment of a tube grinding tool **30*b* is illustrated. The grinding tool 30*b* can include a grinding tool shaft 34 connected to a grinding tool head 40 with a working surface 60 similar to the previous embodiments of the grinding tool 30 and grinding tool 30*a*. A centering rod 70 can extend from the working surface 60 in opposite direction from that of the shaft 34 in a manner similar to the centering rod 70 of the grinding tool 30*a*. The centering rod 70 can include a cutting element 80 formed proximate one end thereof. The cutting element 80** can include a sharp cutting edge 82 that transitions into a recessed cavity 84 that is operable to hold and/or remove shaving material from the work piece that has been cut by the cutting element 80.

Figure 7:
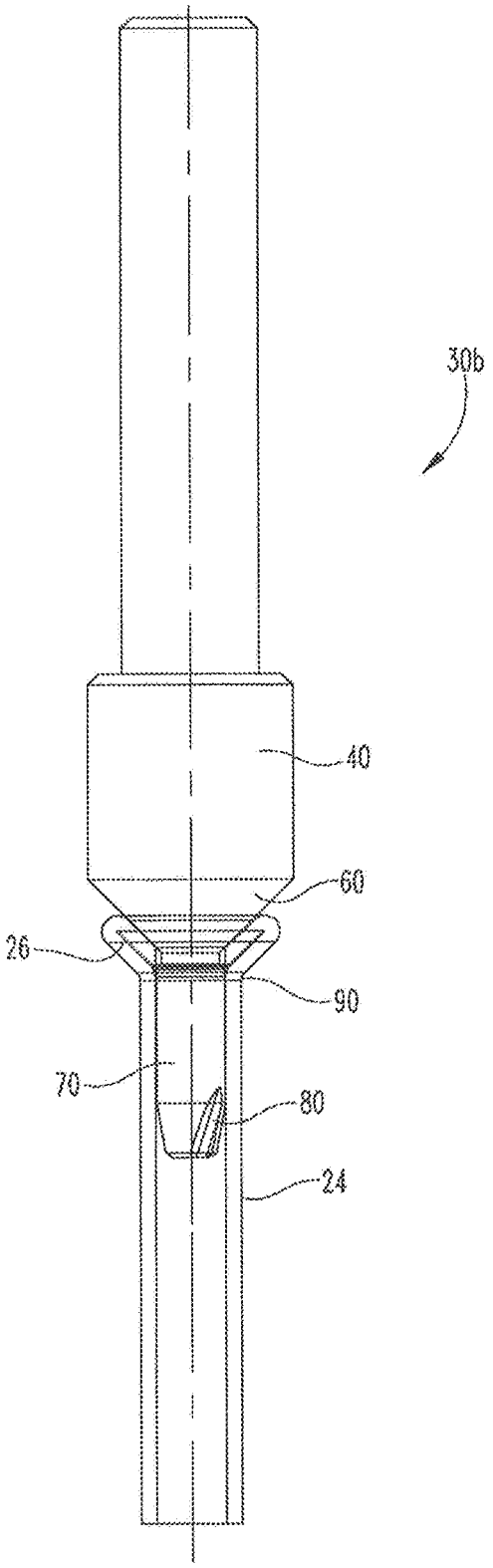
FIG. 7 is a side view of the tube grinding tool of FIG. 6 engaged with a flared tube partially cut away.

FIG. 7 shows an operational view of the grinding tool 30*b* engaged with a tube 24. The centering rod 70 extends through the center of the tube 24 and the cutting element 80 can be used to remove material in a throat area 90 of the tube 24. Material removal can be required in some tubes if the throat has material that protrudes inward from the inner diameter of the tube 24 and restricts the centering rod 70 from passing therethrough. The cutting element 80 can be used to remove an amount of material necessary to provide access for the centering rod 70 to slide into the tube 24 and permit the working surface 60 of the grinding head 40 to engage with the flared end 26 of the tube 24. The working surface 60 can then be rotated in one direction and/or in alternating opposite directions so as to form a desired surface finish on flared end 26 that is capable of providing a fluid tight seal with a fitting or a connector.

Figure 8:
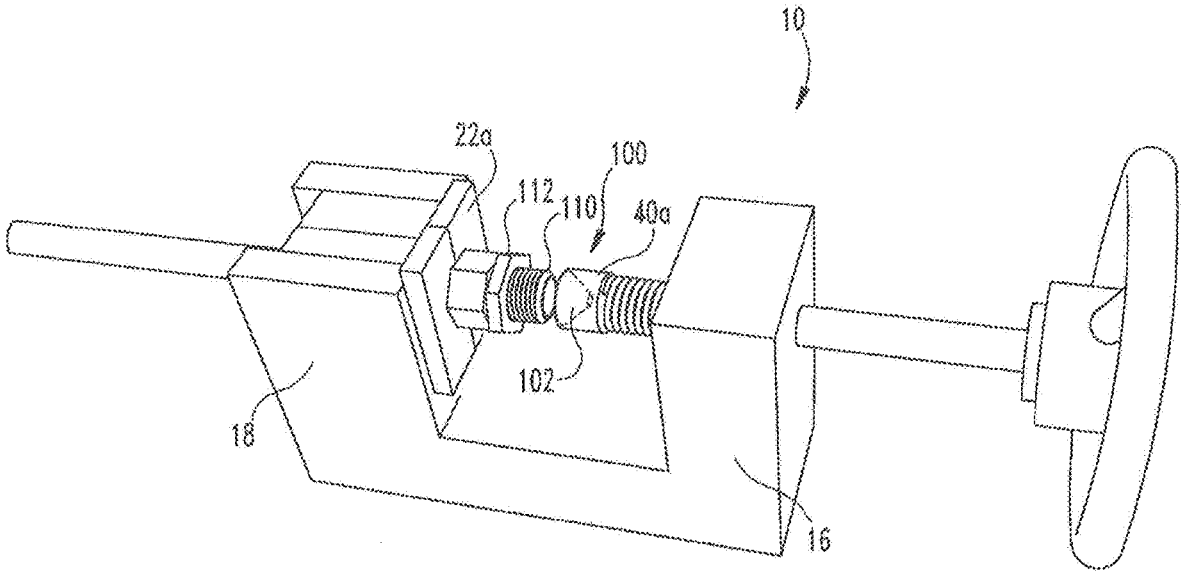
FIG. 8 is a schematic perspective view of a hand operated grinding apparatus having a grinding tool configured to grind a flared end of a male fitting.

Referring now to FIG. 8, a hand operated grinding apparatus 10 is shown in yet another embodiment. The figure illustrates a male work piece grinding tool 100 that includes a working surface 102 configured to grind a flared end 110 of a male fitting 112. A collet 20*a* can threadingly receive the male fitting 112. The collet 20*a* can be adapted to engage with the work piece yoke 18 similar to the work piece collet 20 used to hold a flared tube 24. The male grinding tool 100 is used in a similar fashion to the tube grinding tool described previously. A working or grinding head 40*a* can be engaged with the flared end 110 of the male fitting 112 and rotated in one and/or alternate opposing directions until the surface finish of the flared end 110 of the male fitting 112, including roughness and flatness, meets a desired criteria.

Figure 9:
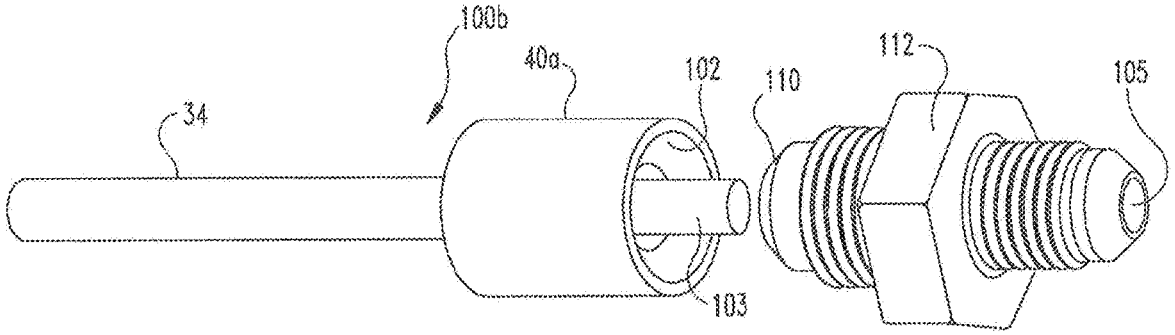
FIG. 9 is a perspective view of an alternate embodiment of a grinding tool with a centering rod configured to grind a flared end of a male fitting.

Referring now to FIG. 9, an alternate embodiment of a male grinding tool 100*b* includes a working head 40*a* with an inverse flared surface 102 for grinding the surface 110 of a male or flare fitting 112 is illustrated. The male grinding tool 100*b* can include a centering rod 103 extending from the working head 40*a* opposite of the grinding tool shaft 34. The centering rod 103 is sized to slidingly engage within a through hole 105 formed in the male fitting 112. Once the centering rod 103 is engaged with the through hole 105 the working head 40*a* will be properly aligned with the flared surface 110 of the male fitting 112 and thereby facilitating a precisely finished flared surface 110 with the grinding tool 100*b*. The centering rod 103 can be rotated and longitudinally slid within the through hole 105 during a surface finishing procedure.

Figure 10:
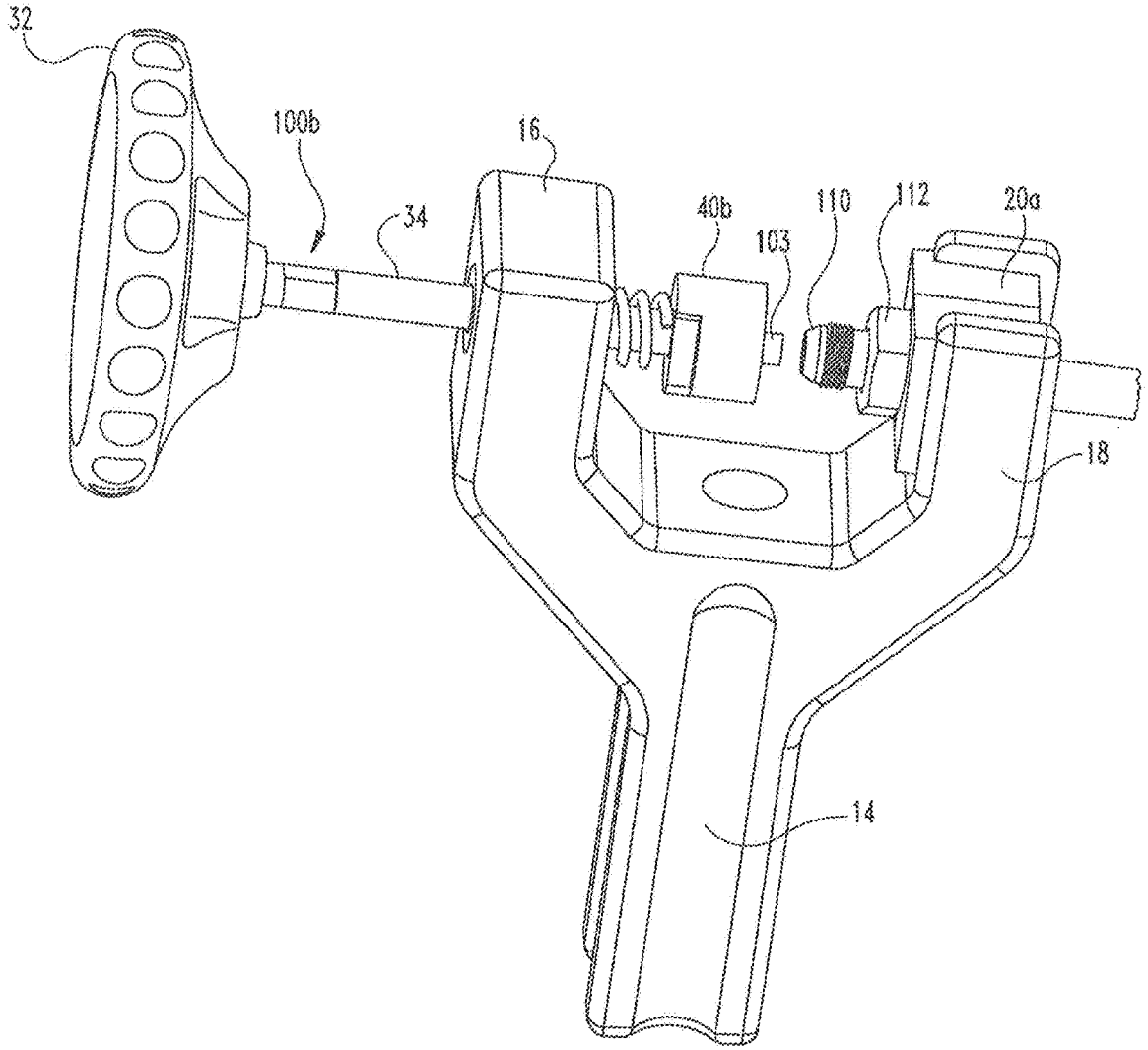
FIG. 10 is a perspective view of a hand operated grinding apparatus with the male grinding tool of FIG. 9.

Referring now to FIG. 10, a hand operated grinding apparatus 10 is shown with the male grinding tool 100*b* assembled with the grinding tool yoke 16. A collet 20*a* can threadingly receive the male fitting 112 to hold the fitting 112 with respect to the apparatus 10. The collet 20*a* can be adapted to fixedly engage with the work piece yoke 18 similar to the work piece collet 20 used to hold a flared tube 24. The working or grinding head 40*b* can be aligned with the fitting 112 by engaging the centering rod 103 within the through hole 105 of the fitting 112 and the flared grinding surface 102 can then provide a desired surface finish to the flared end surface 110 of the male fitting 112 when the hand actuator 32 is rotated in one and/or alternate opposing directions while in the grinding surface 102 is in contact with the flared surface 110.

Figure 11:
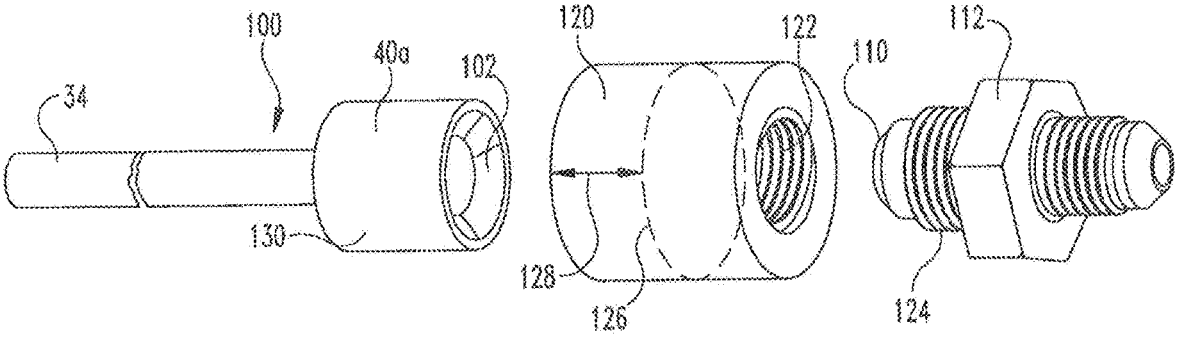
FIG. 11 is a perspective view of an alternate embodiment of a grinding tool with a tool head guide configured to grind a flared end of a male fitting.

Referring now to FIG. 11, yet another embodiment is depicted of a male grinding tool 100 includes a working head 40*a* with an inverse flared surface 102 for grinding the surface 110 of a male fitting 112. The male grinding tool 100 is similar to the tool 100 shown in FIG. 8, however in this embodiment a guide cylinder 120 is utilized to align the grinding tool 100 with the male fitting 112. The guide cylinder 120 can include threads 122 for threadingly engaging with coupling threads 124 formed on the male fitting 112. Alternatively the guide cylinder 120 can be coupled with the collet 20 as one skilled in the art would readily understand. Threads 122 end at an intermediate position denoted by dashed line 126 and a smooth bore on the inner diameter of the guide cylinder 120 is formed along the guide portion denoted by arrow 128. This inner diameter of the guide portion 128 of the guide cylinder 120 is configured to correspond with an outer diameter surface 130 of the grinding cylinder head 40*a*. As the tool head 40*a* is directed toward the male fitting 112, the guide cylinder 120 will align the guide head 40*a* with the flared surface 110 of the male fitting 112 and thereby facilitating a precisely finished flared surface 110. The cylindrical grinding head 40*a* can be rotated and longitudinally slid within the guide portion 128 of the guide cylinder 120 during a surface finishing procedure.

Figure 12:
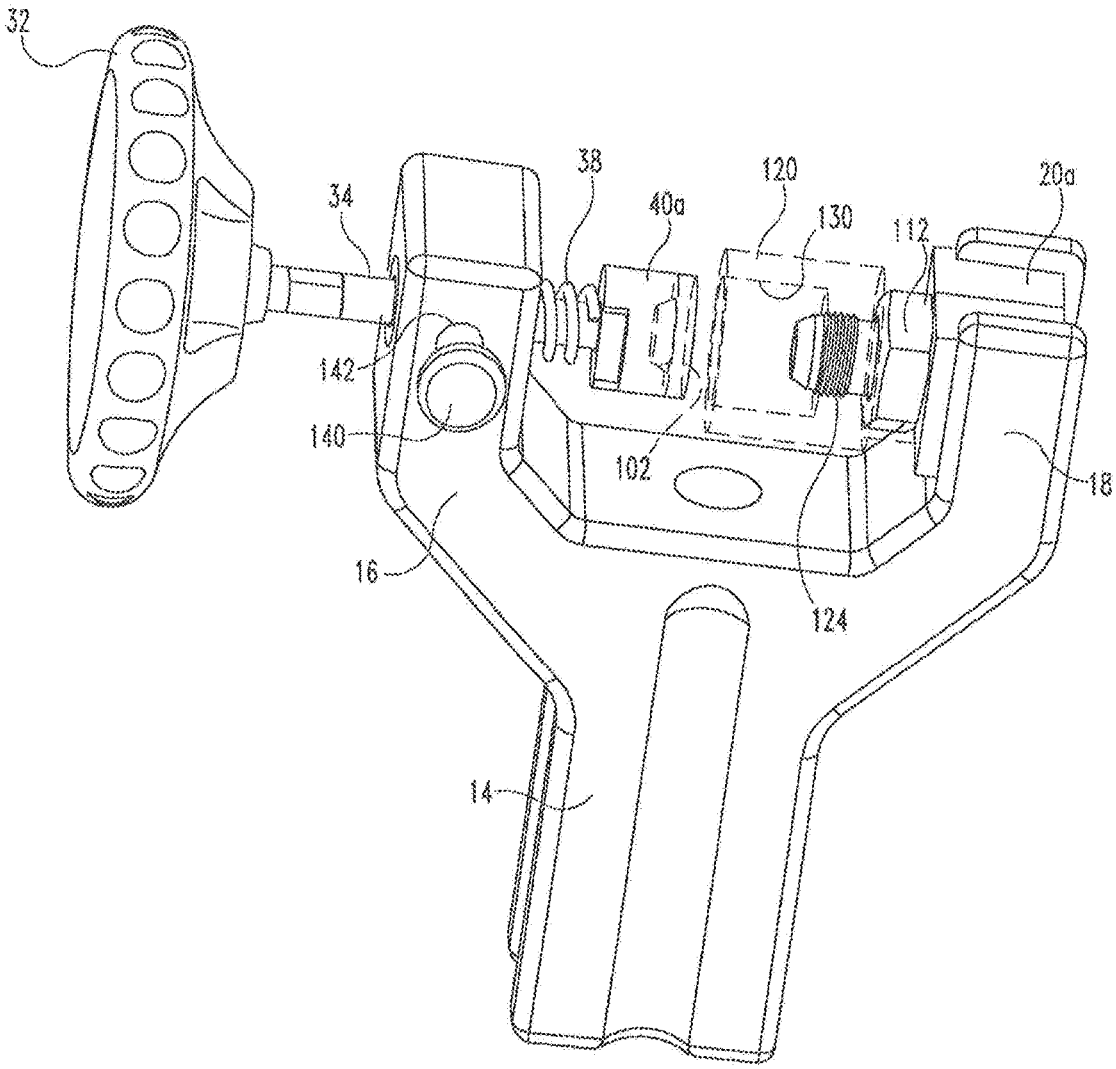
FIG. 12 is a perspective view of a hand operated grinding apparatus with the grinding tool of FIG. 11.

Referring now to FIG. 12, a hand operated grinding apparatus 10 is shown with the male grinding tool 100 assembled with the grinding tool yoke 16. A collet 20*a* can threadingly receive the male fitting 112 to hold the fitting 112 with respect to the apparatus 10. The collet 20*a* can be adapted to fixedly engage with the work piece yoke 18 similar to the work piece collet 20 used to hold a flared tube 24. The working or grinding head 40*a* can be aligned with the fitting 112 by engaging the fitting 112 through the guide portion 128 of the guide cylinder 120. The grinding head 40*a* can then provide a desired surface finish to the flared end surface 110 of the male fitting 112 when the hand actuator 32 is rotated in one and/or alternate opposing directions while the grinding surface 102 is in contact with the flared surface 110. It should be noted that while the guide cylinder 120 is depicted with reference to finishing a male fitting in the present disclosure, a guide cylinder can also be used with other grinding tool configurations such as those used for finishing female flared surfaces of tubes and the like.

A lock button 140 can be used in some embodiments of the present disclosure to lock the grinding tool 100 or the tube grinding tool 30 in a retracted position. Although the lock button 140 is only shown in the embodiment illustrated in FIG. 12, it should be understood that this feature can be used with any embodiment disclosed and/or defined by the claims of this application. The lock button 140 includes an elongate pin 142 that can extend through the grinding tool yoke 16 and engage with a portion of the shaft 34 of the grinding tool. The pin 142 can be configured to engage with features such as a groove, indentation, blind hole, through hole or any other feature that can be used to lockingly engage the shaft 34 as would be understood by one skilled in the art. The pin 142 can include shaped features (not shown) on the end thereof such as a narrowing portion or other geometric changes from that of the shape and size of the pin 142. The shaft 34 can be retracted and the lock button 140 can be depressed to engage a locking feature (not shown) formed in the shaft to hold the shaft and withstand the force of the spring 38. The lock button 140 can then retracted as desired to permit the shaft 34 to return to a spring induced forward position.

Grinding tool heads, both male and female configurations contemplated by the present disclosure can be formed in various sizes, angles and shapes to correspond to the surface configuration of a work piece that will be ground, lapped or otherwise finished. The grinding tool heads can be defined by criteria for flatness, smoothness and curvature along a longitudinal axis. Grinding heads can be designed to engage standard flare fitting styles such as a 45-degree SAE and a 37-degree AN or alternatively can be designed to engage with non-standard styles. The grinding apparatus and grinding tool, including components such as the hand actuator, shaft and grinding tool head, collet and yokes can be formed from any suitable material as desired. Material selection can include but is not limited to metals, ceramics, composites, plastics and combinations thereof. In one nonlimiting example, the grinding tool head can be made of tool steel or the like, and can be hardened through heat treat methods known to those skilled in the art. After forming the grinding head, additional material or coatings can be added through post heat treat processing. Such material addition can include diamond coatings, diamond dust, or other hardened particles as discussed previously.

It should also be understood that any feature described in this disclosure with respect to one embodiment is contemplated to apply to all other embodiments disclosed and claimed herein. A collet 20 formed of one or more pieces can be utilized to hold a tube or a fitting and the like in position relative to the work piece yoke 18. A collet 20 can also have a guide cylinder 120 connected thereto to provide alignment to the grinding tool. The connection of the collet 20 and guide cylinder 120 can be permanent such as through a weld joint or an integral formation or alternatively can be removable such as through threaded engagement or removable fasteners.

The grinding tools 30, 100, 100*b* can be assembled with the grinding tool yoke 16 in a variety of ways and should not be limited by the disclosed embodiments provided herein. In one form, the shaft 34 can be extended through the aperture 36 and a biasing member 38 such as a spring can be positioned between the grinding yoke 16 and the grinding head 40. The grinding heads 40, 40*a* can then be assembled to the shaft 34 such as through internal threaded engagement or with separate fasteners, rivets or screws and the like. Alternatively, the grinding head 40 can be press fit on to the shaft 34 or formed as an integral one-piece construction with the shaft 34. After the biasing member 38 and grinding head 40 are placed on the internal portions of the shaft relative to the grinding yoke 16, the hand wheel 32 can then be attached to the other end of the shaft 34 via similar mechanical means as the grinding head 40.

The optional biasing member 38 can be designed so as to provide a desired amount of force between the grinding head 40 and the work piece in some embodiments. The operator can apply additional translational force to the work piece through an actuator member such as hand wheel 32 or other forms such as for example sliding bars or an adapter for a power rotary tool or the like. The actuator member such as hand wheel 32 can be rotated in a clockwise and/or counterclockwise direction with or without applying additional force on the work piece during a grinding operation to form a desired finish on the interface surface of the work piece. After the work piece is finished, the grinding tool can be retracted to permit the collet 20 to be removed from the work piece yoke 18. In some embodiments a lock button 140 can be depressed to lock the grinding tool in the retracted position and released as desired. In this manner, a work piece such as tubes and fittings with flared ends can be ground and finished such that fluid leaks are prevented between work piece connections.

Referring now to FIGS. 13-21, a repair tool kit is illustrated with a plurality of repair tools for use in repairing a seal surface on a plurality of sizes of male flare fittings. While the kit of repair tools are shown for flare fitting sizes of 3/16 inch, 1/4 inch, 3/16 inch, 1/2 inch, 5/8 inch, 3/4 inch, and 1 inch, it should be understood that other sizes including metric sizes may be provided by the disclosed repair kit. The repair tools can be used to repair and finish a seal interface surface of a flare fitting for a fluid conduit. Flare fittings can be used with metal tubing, such as ductile steel, copper and aluminum, however other materials can also be used. During assembly, a flare nut is used to secure the flared tubing's tapered end to the tapered fitting, producing a pressure-resistant, leak-tight seal as is known to those skilled in the art. Common flare fittings include a 45-degree SAE style and a 37-degree AN style, however the repair tools described herein can be used on any type of flare fitting.

Figure 13:
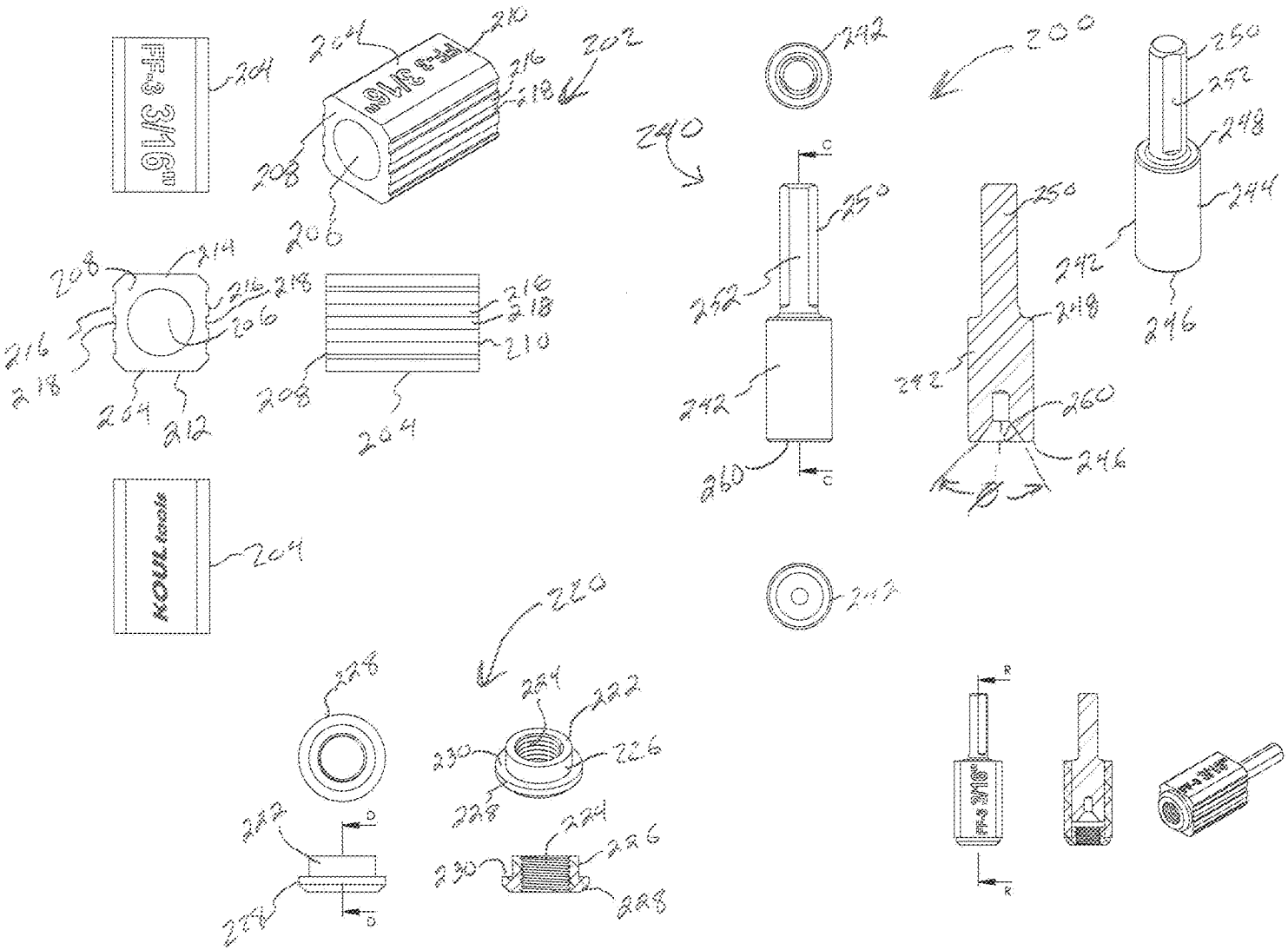
FIG. 13 shows various views of a repair tool for a 3/16-inch flare fitting.

Referring more particularly to FIG. 13, a repair tool 200 for a 3/16 inch flare fitting is illustrated. The repair tool 200 includes a tool head guide 202 defined partially by a guide housing 204. The guide housing 204 includes an internal bore 206 that forms a cylindrical guide aperture that extends between a first end 208 and a second end 210 thereof. In one form the guide housing 204 can include a perimeter wall 212 that includes a plurality of sides 214. One or more of the sides 214 can include a plurality of ribs 216 protruding outward therefrom with a channel 218 formed between each adjacent pair of ribs 216. The ribs 216 are configured to provide a gripping feature when hand held during a repair operation. In one form the ribs 216 are parallel to one another. In another form, at least one of the ribs 216 can be non-parallel to one of the other ribs 216. Alternatively the guide housing 204 may be held with a mechanical clamp or the like during a repair operation.

A threaded element 220 can be positioned at one end of the guide housing 204. In some forms threads can be integrally formed with a portion of the internal bore 206 of the guide housing 204. In other forms the threaded element 220 is a separate component that is connected to the guide housing 204. The threaded element 220 may be pressed, glued, welded or otherwise affixed to one end of the guide housing 204. The threaded element 220 is configured to threadingly receive a flare fitting (not shown) and is operable to hold the flare fitting in a desired position during a repair operation. The threaded element 220 includes a cylindrical insert 222 having internal threads formed in an inner wall 224 thereof and an outer wall 226 sized to engage the internal bore of the guide aperture 206 of the tool head guide 202. A flange 228 extends outward from the outer wall 226 at one end of the threaded element 220. A rim 230 is formed on an inner portion of the flange 228. The rim 230 can form a locating interface region of the threaded element 220 with one of the first or second ends 208, 210 of the tool head guide housing 204.

The repair tool 200 includes a surfacing tool 240 configured to grind, polish, repair or otherwise form a finished seal surface on a flare fitting. The surfacing tool 240 includes a tool head 242 configured to slide in an axial direction through the guide aperture 206 of the guide housing 204. The tool head 242 can independently rotate within the guide aperture 206 of the guide housing 204 while either moving or fixed in an axial position within the guide housing 204. The tool head 242 includes a cylindrical outer wall 244 extending between a first end 246 and a second end 248. A shaft 250 extends from the tool head 242 to form a drive input to the tool head 242. The shaft 250 can be rotated via hand operation or an electrical or pneumatic rotary tool (not shown). The shaft 250 is configured transmit an axial and/or a rotational movement to the tool head 242. A gripping feature 252 such as a flat, a recession or a protrusion and the like may be formed with the shaft 250 to permit means for torque transmission from a rotary tool or a hand grip.

A reverse flare working surface 260 generally shaped as an internal cone like feature is formed proximate the first end 246 of the tool head 242. The working surface 260 is configured to grind, polish, form or otherwise repair a flared interface sealing surface of a 3/16 inch flare fitting. A flare angle Ø of the working surface 260 can be any standard or nonstandard angle that is configured to engage the seal surface of the flare fitting. By way of example and not limitation, the angle Ø can be 74 degrees, 45 degrees, 60 degrees or other desired angle. In some forms, the working surface 260 can be made from a material that is the same as other portions of the tool head 242. In other forms, the working surface 260 can be made from a material that is different from other portions of the tool head 242. Further, the working surface 260 can include a material coating to increase the grinding effectiveness of the tool head 242. The material coating can include natural or man-made constituents. In some forms, the material coating can include diamond particles or other abrasive substances to facilitate material removal of damaged portions of the seal surface of the flare fitting.

Figure 14:
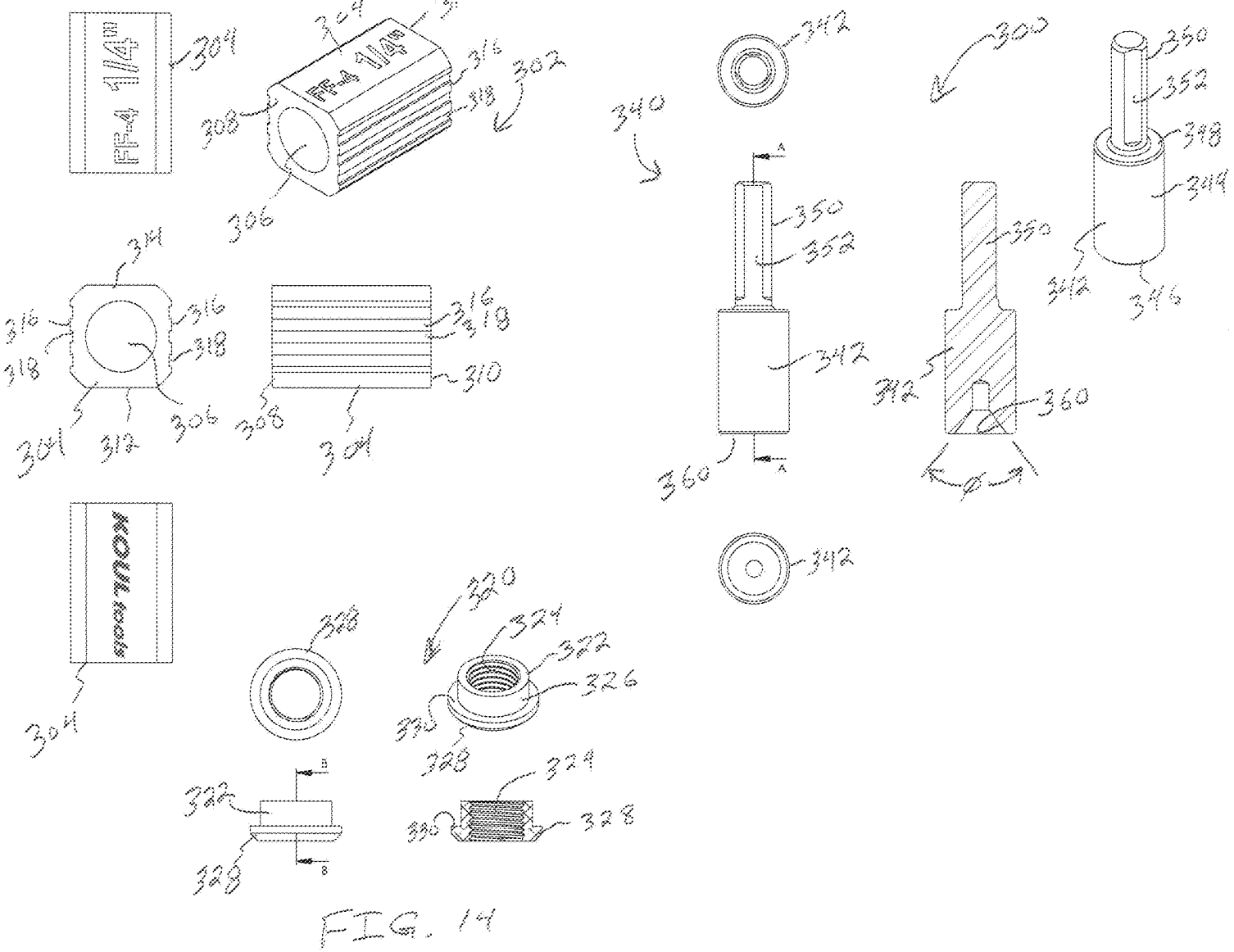
FIG. 14 shows various views of a repair tool for a 1/4-inch flare fitting.

Referring more particularly to FIG. 14, a repair tool 300 for a ¼ inch flare fitting is illustrated. The repair tool 300 includes a tool head guide 302 defined partially by a guide housing 304. The guide housing 304 includes an internal bore 306 that forms a cylindrical guide aperture that extends between a first end 308 and a second end 310 thereof. In one form the guide housing 304 can include a perimeter wall 312 that includes a plurality of sides 314. One or more of the sides 314 can include a plurality of ribs 316 protruding outward therefrom with a channel 318 formed between each adjacent pair of ribs 316. The ribs 316 are configured to provide a gripping feature when hand held during a repair operation. In one form the ribs 316 are parallel to one another. In another form, at least one of the ribs 316 can be non-parallel to one of the other ribs 316. Alternatively the guide housing 304 may be held with a mechanical clamp or the like during a repair operation.

A threaded element 320 can be positioned at one end of the guide housing 304. In some forms threads can be integrally formed with a portion of the internal bore 306 of the guide housing 304. In other forms the threaded element 320 is a separate component that is connected to the guide housing 304. The threaded element 320 may be pressed, glued, welded or otherwise affixed to one end of the guide housing 304. The threaded element 320 is configured to threadingly receive a flare fitting (not shown) and is operable to hold the flare fitting in a desired position during a repair operation. The threaded element 320 includes a cylindrical insert 322 having internal threads formed in an inner wall 324 thereof and an outer wall 326 sized to engage the internal bore of the guide aperture 306 of the tool head guide 302. A flange 328 extends outward from the outer wall 326 at one end of the threaded element 320. A rim 330 is formed on an inner portion of the flange 328. The rim 330 can form a locating interface region of the threaded element 320 with one of the first or second ends 308, 310 of the tool head guide housing 304.

The repair tool 300 includes a surfacing tool 340 configured to grind, polish, repair or otherwise form a finished seal surface on a flare fitting. The surfacing tool 340 includes a tool head 342 configured to slide in an axial direction through the guide aperture 306 of the guide housing 304. The tool head 342 can independently rotate within the guide aperture 306 of the guide housing 304 while either moving or fixed in an axial position within the guide housing 304. The tool head 342 includes a cylindrical outer wall 344 extending between a first end 346 and a second end 348. A shaft 350 extends from the tool head 342 to form a drive input to the tool head 342. The shaft 350 can be rotated via hand operation or an electrical or pneumatic rotary tool (not shown). The shaft 350 is configured transmit an axial and/or a rotational movement to the tool head 342. A gripping feature 352 such as a flat, a recession or a protrusion and the like may be formed with the shaft 350 to permit means for torque transmission from a rotary tool or a hand grip.

A reverse flare working surface 360 generally shaped as an internal cone like feature is formed proximate the first end 346 of the tool head 342. The working surface 360 is configured to grind, polish, form or otherwise repair a flared interface end sealing surface of a ¼ inch flare fitting. A flare angle Ø of the working surface 360 can be any standard or nonstandard angle that is configured to engage the seal surface of the flare fitting. By way of example and not limitation, the angle Ø can be 74 degrees, 45 degrees, 60 degrees or other desired angle. In some forms, the working surface 360 can be made from a material that is the same as other portions of the tool head 342. In other forms, the working surface 360 can be made from a material that is different from other portions of the tool head 342. Further, the working surface 360 can include a material coating to increase the grinding effectiveness of the tool head 342. The material coating can include natural or man-made constituents. In some forms, the material coating can include diamond particles or other abrasive substances to facilitate material removal of damaged portions of the seal surface of the flare fitting.

Figure 15:
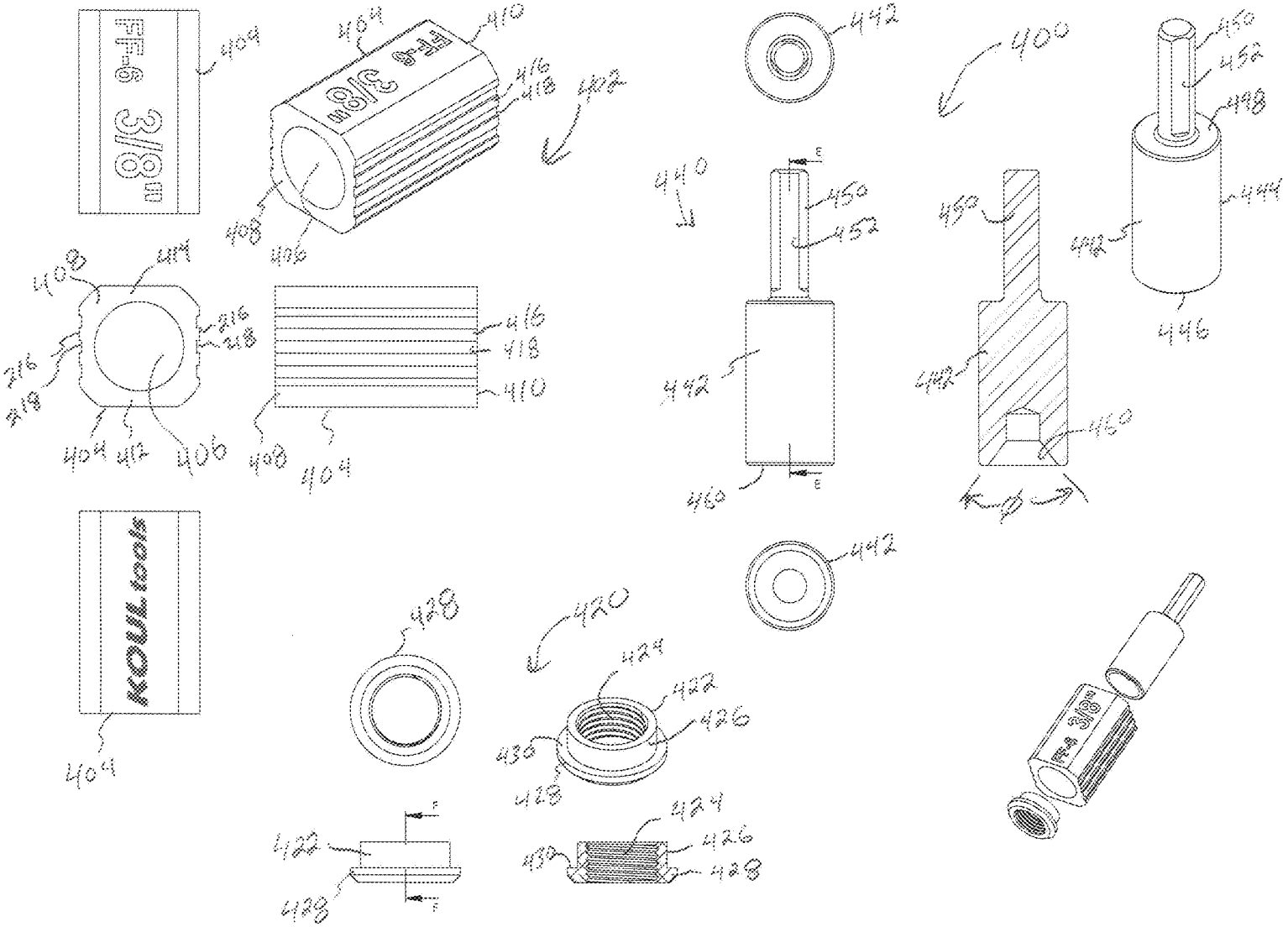
FIG. 15 shows various views of a repair tool for a 3/8-inch flare fitting.

Referring more particularly to FIG. 15, a repair tool 400 for a ⅜ inch flare fitting is illustrated. The repair tool 400 includes a tool head guide 402 defined partially by a guide housing 404. The guide housing 404 includes an internal bore 406 that forms a cylindrical guide aperture that extends between a first end 408 and a second end 410 thereof. In one form the guide housing 404 can include a perimeter wall 412 that includes a plurality of sides 414. One or more of the sides 414 can include a plurality of ribs 416 protruding outward therefrom with a channel 418 formed between each adjacent pair of ribs 416. The ribs 416 are configured to provide a gripping feature when hand held during a repair operation. In one form the ribs 416 are parallel to one another. In another form, at least one of the ribs 416 can be non-parallel to one of the other ribs 416. Alternatively the guide housing 402 may be held with a mechanical clamp or the like during a repair operation.

A threaded element 420 can be positioned at one end of the guide housing 404. In some forms threads can be integrally formed with a portion of the internal bore 406 of the guide housing 404. In other forms the threaded element 420 is a separate component that is connected to the guide housing 404. The threaded element 420 may be pressed, glued, welded or otherwise affixed to one end of the guide housing 404. The threaded element 420 is configured to threadingly receive a flare fitting (not shown) and is operable to hold the flare fitting in a desired position during a repair operation. The threaded element 420 includes a cylindrical insert 422 having internal threads formed in an inner wall 424 thereof and an outer wall 426 sized to engage the internal bore of the guide aperture 406 of the tool head guide 402. A flange 428 extends outward from the outer wall 426 at one end of the threaded element 420. A rim 430 is formed on an inner portion of the flange 428. The rim 430 can form a locating interface region of the threaded element 420 with one of the first or second ends 408, 410 of the tool head guide housing 404.

The repair tool 400 includes a surfacing tool 440 configured to grind, polish, repair or otherwise form a finished seal surface on a flare fitting. The surfacing tool 440 includes a tool head 442 configured to slide in an axial direction through the guide aperture 406 of the guide housing 404. The tool head 442 can independently rotate within the guide aperture 406 of the guide housing 404 while either moving or fixed in an axial position within the guide housing 404. The tool head 442 includes a cylindrical outer wall 444 extending between a first end 446 and a second end 448. A shaft 450 extends from the tool head 442 to form a drive input to the tool head 442. The shaft 450 can be rotated via hand operation or an electrical or pneumatic rotary tool (not shown). The shaft 450 is configured transmit an axial and/or a rotational movement to the tool head 442. A gripping feature 452 such as a flat, a recession or a protrusion and the like may be formed with the shaft 450 to permit means for torque transmission from a rotary tool or a hand grip.

A reverse flare working surface 460 generally shaped as an internal cone like feature is formed proximate the first end 446 of the tool head 442. The working surface 460 is configured to grind, polish, form or otherwise repair a flared interface end sealing surface of a ⅜ inch flare fitting. A flare angle Ø of the working surface 460 can be any standard or nonstandard angle that is configured to engage the seal surface of the flare fitting. By way of example and not limitation, the angle Ø can be 74 degrees, 45 degrees, 60 degrees or other desired angle. In some forms, the working surface 460 can be made from a material that is the same as other portions of the tool head 442. In other forms, the working surface 460 can be made from a material that is different from other portions of the tool head 442. Further, the working surface 460 can include a material coating to increase the grinding effectiveness of the tool head 442. The material coating can include natural or man-made constituents. In some forms, the material coating can include diamond particles or other abrasive substances to facilitate material removal of damaged portions of the seal surface of the flare fitting.

Figure 16:
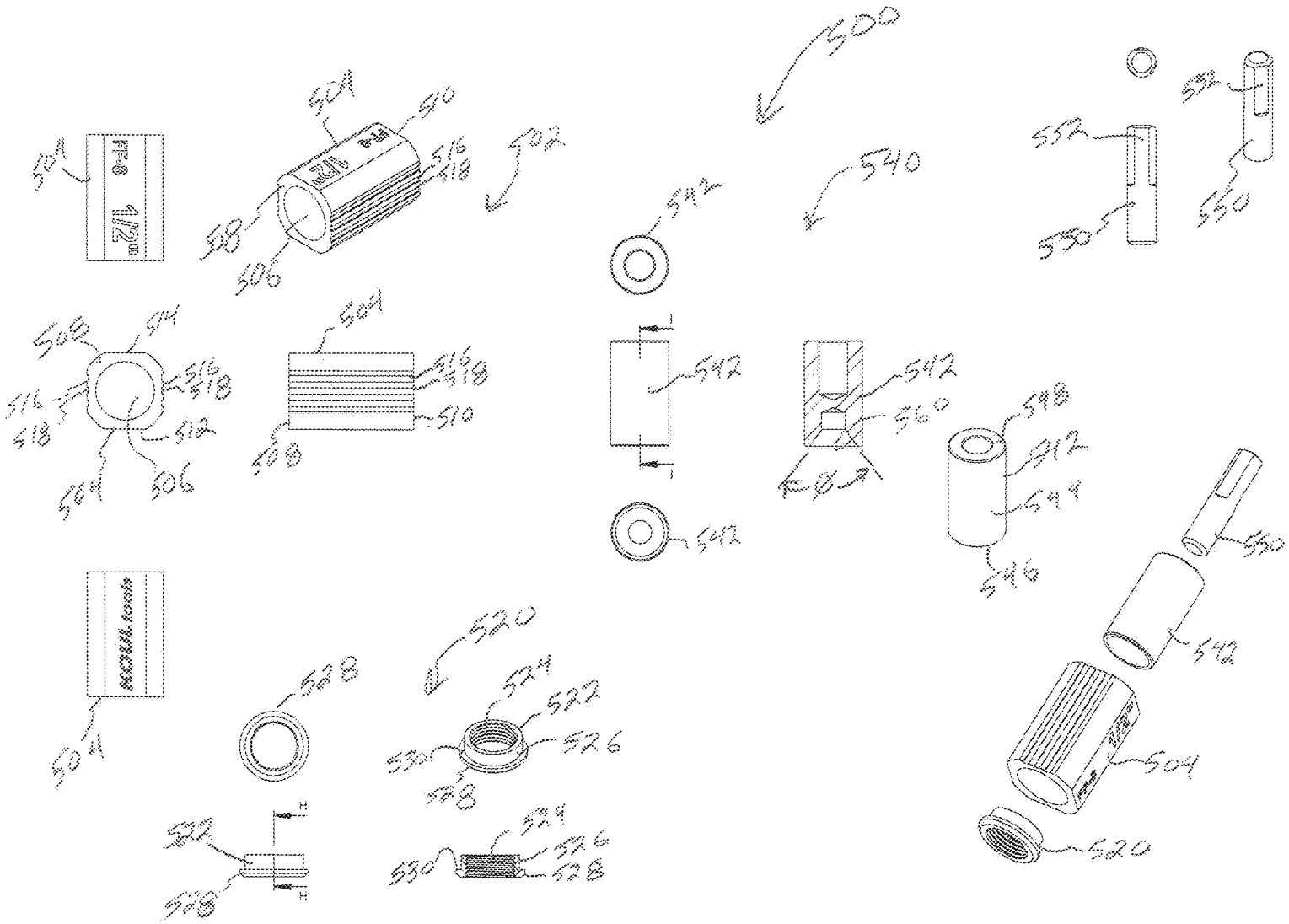
FIG. 16 shows various views of a repair tool for a 1/2-inch flare fitting.

Referring more particularly to FIG. 16, a repair tool 500 for a ½ inch flare fitting is illustrated. The repair tool 500 includes a tool head guide 502 defined partially by a guide housing 504. The guide housing 504 includes an internal bore 506 that forms a cylindrical guide aperture that extends between a first end 508 and a second end 510 thereof. In one form the guide housing 504 can include a perimeter wall 512 that includes a plurality of sides 514. One or more of the sides 514 can include a plurality of ribs 516 protruding outward therefrom with a channel 518 formed between each adjacent pair of ribs 516. The ribs 516 are configured to provide a gripping feature when hand held during a repair operation. In one form the ribs 516 are parallel to one another. In another form, at least one of the ribs 516 can be non-parallel to one of the other ribs 516. Alternatively the guide housing 502 may be held with a mechanical clamp or the like during a repair operation.

A threaded element 520 can be positioned at one end of the guide housing 504. In some forms threads can be integrally formed with a portion of the internal bore 506 of the guide housing 504. In other forms the threaded element 520 is a separate component that is connected to the guide housing 504. The threaded element 520 may be pressed, glued, welded or otherwise affixed to one end of the guide housing 504. The threaded element 520 is configured to threadingly receive a flare fitting (not shown) and is operable to hold the flare fitting in a desired position during a repair operation. The threaded element 520 includes a cylindrical insert 522 having internal threads formed in an inner wall 524 thereof and an outer wall 526 sized to engage the internal bore of the guide aperture 506 of the tool head guide 502. A flange 528 extends outward from the outer wall 526 at one end of the threaded element 520. A rim 530 is formed on an inner portion of the flange 528. The rim 530 can form a locating interface region of the threaded element 520 with one of the first or second ends 508, 510 of the tool head guide housing 504.

The repair tool 500 includes a surfacing tool 540 configured to grind, polish, repair or otherwise form a finished seal surface on a flare fitting. The surfacing tool 540 includes a tool head 542 configured to slide in an axial direction through the guide aperture 506 of the guide housing 504. The tool head 542 can independently rotate within the guide aperture 506 of the guide housing 504 while either moving or fixed in an axial position within the guide housing 504. The tool head 542 includes a cylindrical outer wall 544 extending between a first end 546 and a second end 548. A shaft 550 extends from the tool head 542 to form a drive input to the tool head 542. The shaft 550 can be rotated via hand operation or an electrical or pneumatic rotary tool (not shown). The shaft 550 is configured transmit an axial and/or a rotational movement to the tool head 542. A gripping feature 552 such as a flat, a recession or a protrusion and the like may be formed with the shaft 550 to permit means for torque transmission from a rotary tool or a hand grip.

A reverse flare working surface 560 generally shaped as an internal cone like feature is formed proximate the first end 546 of the tool head 542. The working surface 560 is configured to grind, polish, form or otherwise repair a flared interface end sealing surface of a ½ inch flare fitting. A flare angle Ø of the working surface 560 can be any standard or nonstandard angle that is configured to engage the seal surface of the flare fitting. By way of example and not limitation, the angle Ø can be 74 degrees, 45 degrees, 60 degrees or other desired angle. In some forms, the working surface 560 can be made from a material that is the same as other portions of the tool head 542. In other forms, the working surface 560 can be made from a material that is different from other portions of the tool head 542. Further, the working surface 560 can include a material coating to increase the grinding effectiveness of the tool head 542. The material coating can include natural or man-made constituents. In some forms, the material coating can include diamond particles or other abrasive substances to facilitate material removal of damaged portions of the seal surface of the flare fitting.

Figure 17:
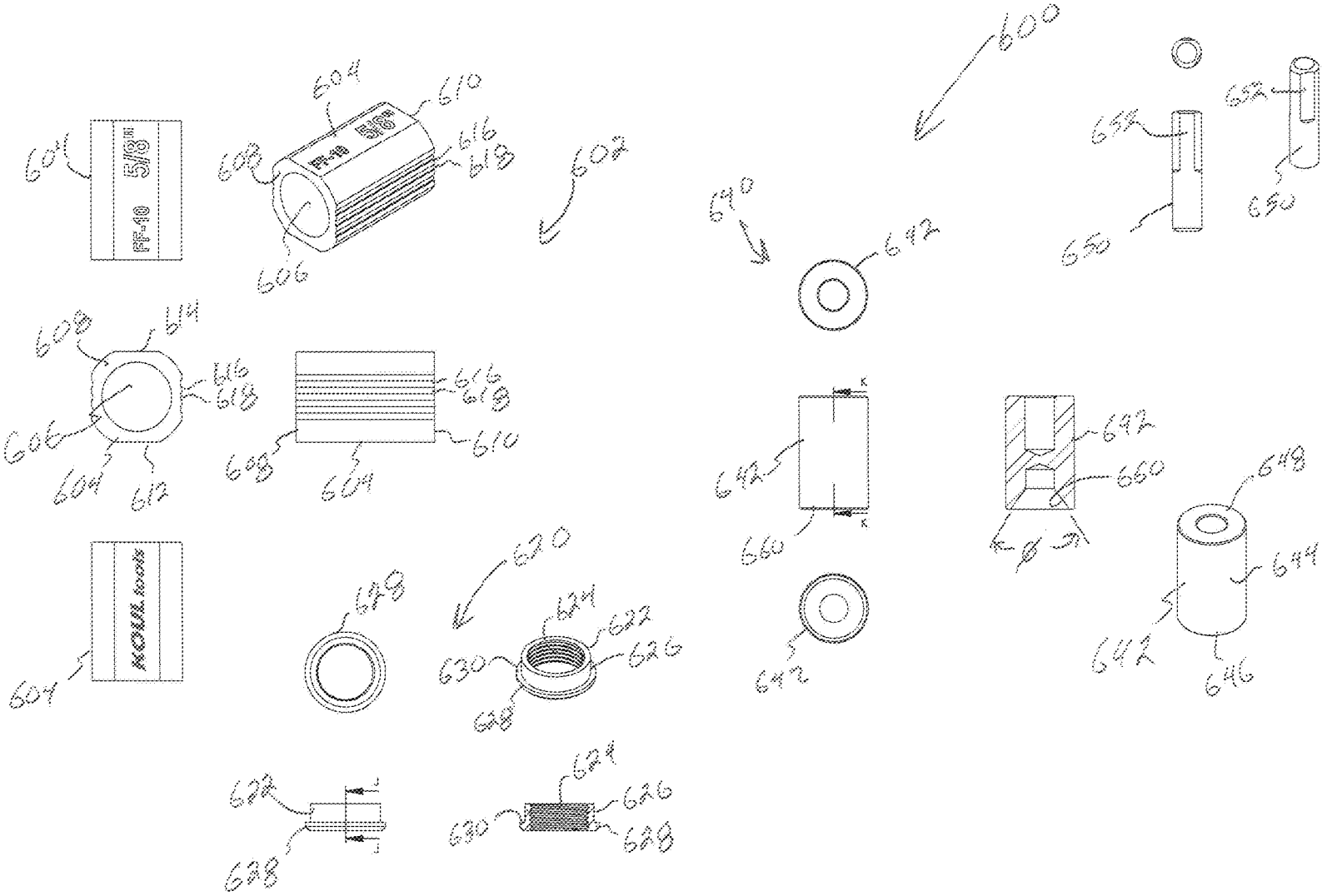
FIG. 17 shows various views of a repair tool for a 5/8-inch flare fitting.

Referring more particularly to FIG. 17, a repair tool 600 for a ⅝ inch flare fitting is illustrated. The repair tool 600 includes a tool head guide 602 defined partially by a guide housing 604. The guide housing 604 includes an internal bore 606 that forms a cylindrical guide aperture that extends between a first end 608 and a second end 610 thereof. In one form the guide housing 604 can include a perimeter wall 612 that includes a plurality of sides 614. One or more of the sides 614 can include a plurality of ribs 616 protruding outward therefrom with a channel 618 formed between each adjacent pair of ribs 616. The ribs 616 are configured to provide a gripping feature when hand held during a repair operation. In one form the ribs 616 are parallel to one another. In another form, at least one of the ribs 616 can be non-parallel to one of the other ribs 616. Alternatively the guide housing 602 may be held with a mechanical clamp or the like during a repair operation.

A threaded element 620 can be positioned at one end of the guide housing 604. In some forms threads can be integrally formed with a portion of the internal bore 606 of the guide housing 604. In other forms the threaded element 620 is a separate component that is connected to the guide housing 604. The threaded element 620 may be pressed, glued, welded or otherwise affixed to one end of the guide housing 604. The threaded element 620 is configured to threadingly receive a flare fitting (not shown) and is operable to hold the flare fitting in a desired position during a repair operation. The threaded element 620 includes a cylindrical insert 622 having internal threads formed in an inner wall 624 thereof and an outer wall 626 sized to engage the internal bore of the guide aperture 606 of the tool head guide 602. A flange 628 extends outward from the outer wall 626 at one end of the threaded element 620. A rim 630 is formed on an inner portion of the flange 628. The rim 630 can form a locating interface region of the threaded element 620 with one of the first or second ends 608, 610 of the tool head guide housing 604.

The repair tool 600 includes a surfacing tool 640 configured to grind, polish, repair or otherwise form a finished seal surface on a flare fitting. The surfacing tool 640 includes a tool head 642 configured to slide in an axial direction through the guide aperture 606 of the guide housing 604. The tool head 642 can independently rotate within the guide aperture 606 of the guide housing 604 while either moving or fixed in an axial position within the guide housing 604. The tool head 642 includes a cylindrical outer wall 644 extending between a first end 646 and a second end 648. A shaft 650 extends from the tool head 642 to form a drive input to the tool head 642. The shaft 650 can be rotated via hand operation or an electrical or pneumatic rotary tool (not shown). The shaft 650 is configured transmit an axial and/or a rotational movement to the tool head 642. A gripping feature 652 such as a flat, a recession or a protrusion and the like may be formed with the shaft 650 to permit means for torque transmission from a rotary tool or a hand grip.

A reverse flare working surface 660 generally shaped as an internal cone like feature is formed proximate the first end 646 of the tool head 642. The working surface 660 is configured to grind, polish, form or otherwise repair a flared interface end sealing surface of a ⅝ inch flare fitting. A flare angle Ø of the working surface 660 can be any standard or nonstandard angle that is configured to engage the seal surface of the flare fitting. By way of example and not limitation, the angle Ø can be 74 degrees, 45 degrees, 60 degrees or other desired angle. In some forms, the working surface 660 can be made from a material that is the same as other portions of the tool head 642. In other forms, the working surface 660 can be made from a material that is different from other portions of the tool head 642. Further, the working surface 660 can include a material coating to increase the grinding effectiveness of the tool head 642. The material coating can include natural or man-made constituents. In some forms, the material coating can include diamond particles or other abrasive substances to facilitate material removal of damaged portions of the seal surface of the flare fitting.

Figure 18:
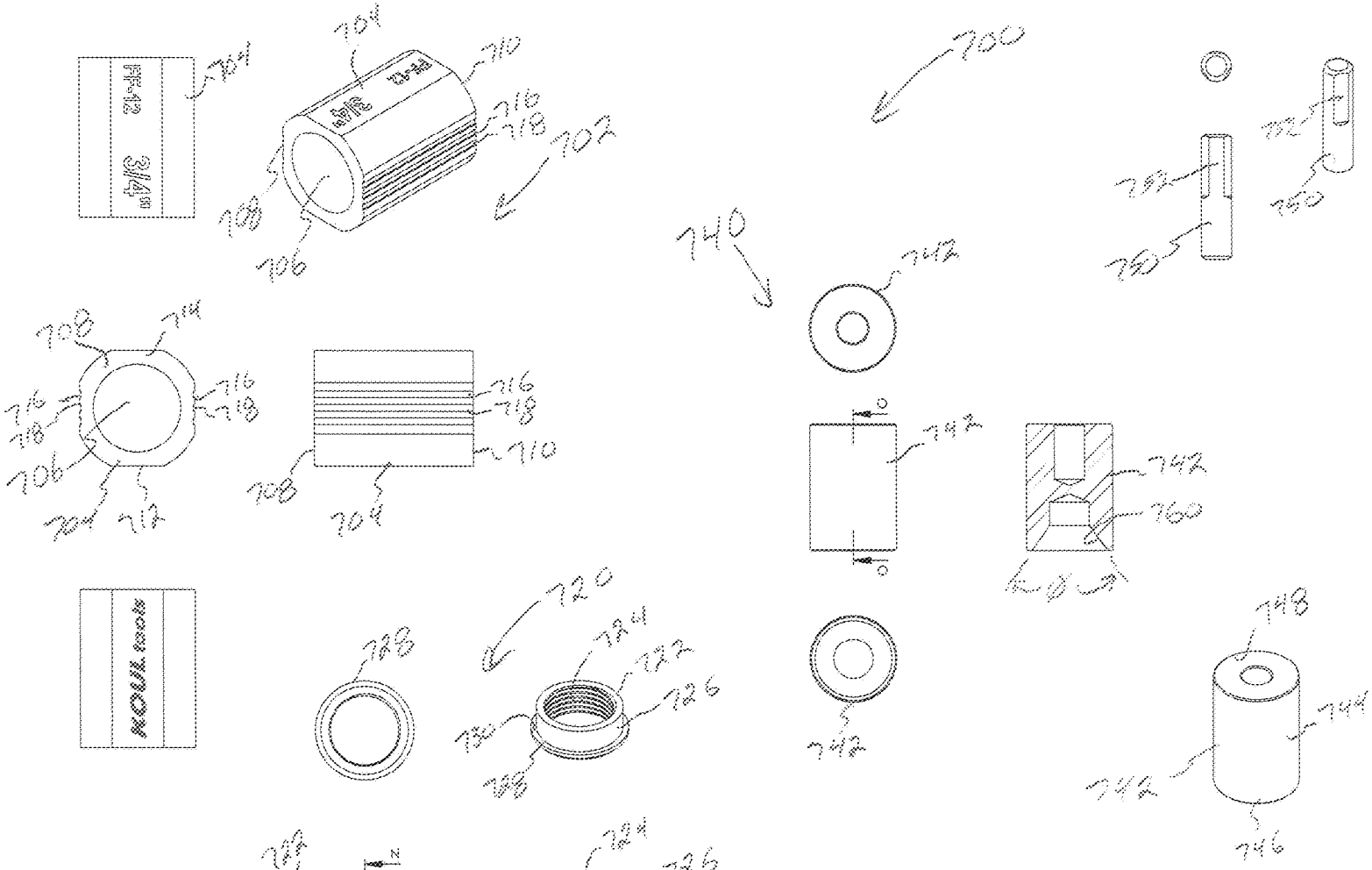
FIG. 18 shows various views of a repair tool for a 3/4-inch flare fitting.

Referring more particularly to FIG. 18, a repair tool 700 for a ¾ inch flare fitting is illustrated. The repair tool 700 includes a tool head guide 702 defined partially by a guide housing 704. The guide housing 704 includes an internal bore 706 that forms a cylindrical guide aperture that extends between a first end 708 and a second end 710 thereof. In one form the guide housing 704 can include a perimeter wall 712 that includes a plurality of sides 714. One or more of the sides 714 can include a plurality of ribs 716 protruding outward therefrom with a channel 718 formed between each adjacent pair of ribs 716. The ribs 716 are configured to provide a gripping feature when hand held during a repair operation. In one form the ribs 716 are parallel to one another. In another form, at least one of the ribs 716 can be non-parallel to one of the other ribs 716. Alternatively the guide housing 704 may be held with a mechanical clamp or the like during a repair operation.

A threaded element 720 can be positioned at one end of the guide housing 704. In some forms threads can be integrally formed with a portion of the internal bore 706 of the guide housing 704. In other forms the threaded element 720 is a separate component that is connected to the guide housing 704. The threaded element 720 may be pressed, glued, welded or otherwise affixed to one end of the guide housing 704. The threaded element 720 is configured to threadingly receive a flare fitting (not shown) and is operable to hold the flare fitting in a desired position during a repair operation. The threaded element 720 includes a cylindrical insert 722 having internal threads formed in an inner wall 724 thereof and an outer wall 726 sized to engage the internal bore of the guide aperture 706 of the tool head guide 702. A flange 728 extends outward from the outer wall 726 at one end of the threaded element 720. A rim 730 is formed on an inner portion of the flange 728. The rim 730 can form a locating interface region of the threaded element 720 with one of the first or second ends 708, 710 of the tool head guide housing 704.

The repair tool 700 includes a surfacing tool 740 configured to grind, polish, repair or otherwise form a finished seal surface on a flare fitting. The surfacing tool 740 includes a tool head 742 configured to slide in an axial direction through the guide aperture 706 of the guide housing 704. The tool head 742 can independently rotate within the guide aperture 706 of the guide housing 704 while either moving or fixed in an axial position within the guide housing 704. The tool head 742 includes a cylindrical outer wall 744 extending between a first end 746 and a second end 748. A shaft 750 extends from the tool head 742 to form a drive input to the tool head 742. The shaft 750 can be rotated via hand operation or an electrical or pneumatic rotary tool (not shown). The shaft 750 is configured transmit an axial and/or a rotational movement to the tool head 742. A gripping feature 752 such as a flat, a recession or a protrusion and the like may be formed with the shaft 750 to permit means for torque transmission from a rotary tool or a hand grip.

A reverse flare working surface 760 generally shaped as an internal cone like feature is formed proximate the first end 746 of the tool head 742. The working surface 760 is configured to grind, polish, form or otherwise repair a flared interface end sealing surface of a ¾ inch flare fitting. A flare angle Ø of the working surface 760 can be any standard or nonstandard angle that is configured to engage the seal surface of the flare fitting. By way of example and not limitation, the angle Ø can be 74 degrees, 45 degrees, 60 degrees or other desired angle. In some forms, the working surface 760 can be made from a material that is the same as other portions of the tool head 742. In other forms, the working surface 760 can be made from a material that is different from other portions of the tool head 742. Further, the working surface 760 can include a material coating to increase the grinding effectiveness of the tool head 742. The material coating can include natural or man-made constituents. In some forms, the material coating can include diamond particles or other abrasive substances to facilitate material removal of damaged portions of the seal surface of the flare fitting.

Figure 19:
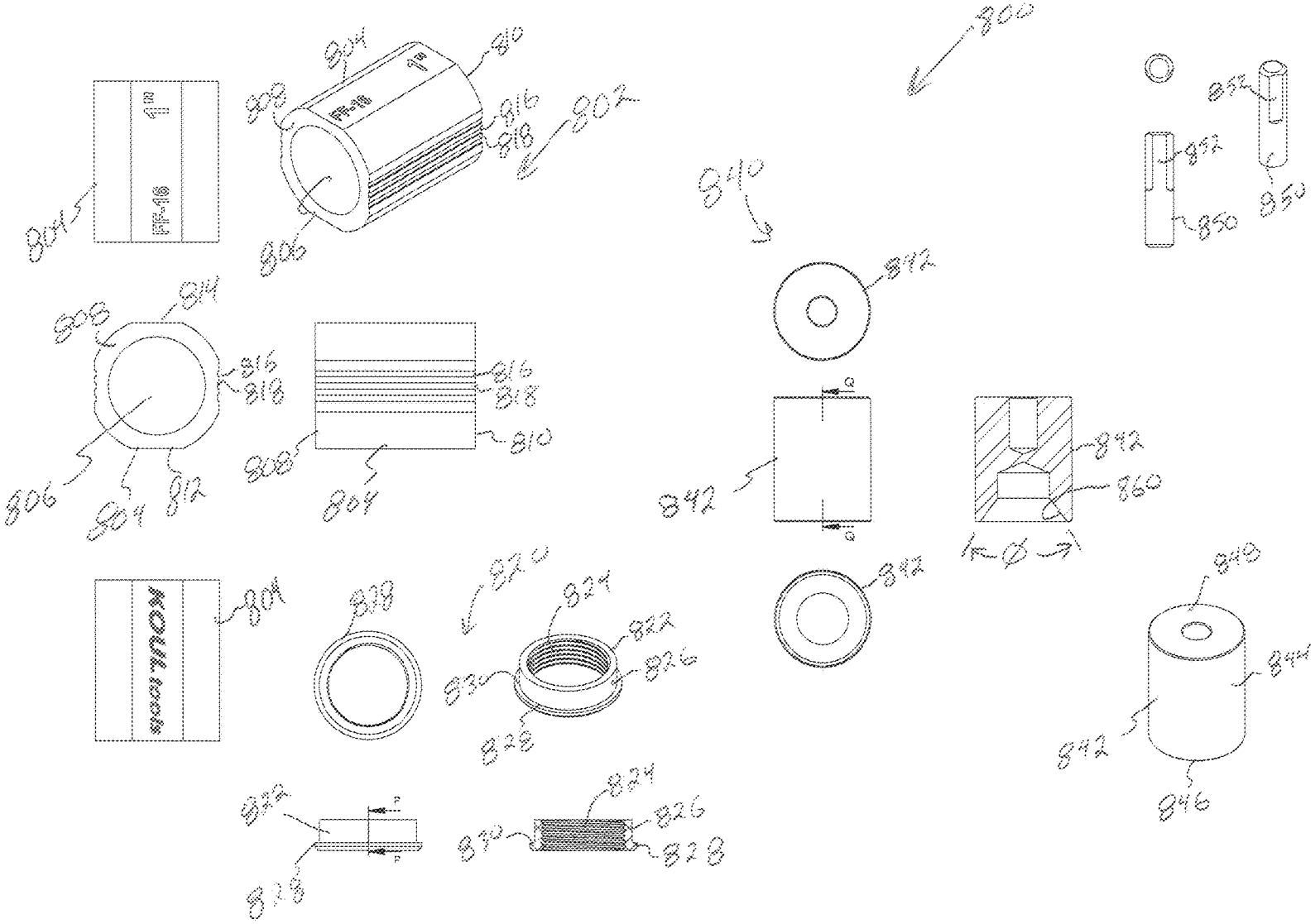
FIG. 19 shows various views of a repair tool for a 1-inch flare fitting.

Referring more particularly to FIG. 19, a repair tool 800 for a 1 inch flare fitting is illustrated. The repair tool 800 includes a tool head guide 802 defined partially by a guide housing 804. The guide housing 804 includes an internal bore 806 that forms a cylindrical guide aperture that extends between a first end 808 and a second end 810 thereof. In one form the guide housing 804 can include a perimeter wall 812 that includes a plurality of sides 814. One or more of the sides 814 can include a plurality of ribs 816 protruding outward therefrom with a channel 818 formed between each adjacent pair of ribs 816. The ribs 816 are configured to provide a gripping feature when hand held during a repair operation. In one form the ribs 816 are parallel to one another. In another form, at least one of the ribs 816 can be non-parallel to one of the other ribs 816. Alternatively the guide housing 804 may be held with a mechanical clamp or the like during a repair operation.

A threaded element 820 can be positioned at one end of the guide housing 804. In some forms threads can be integrally formed with a portion of the internal bore 806 of the guide housing 804. In other forms the threaded element 820 is a separate component that is connected to the guide housing 804. The threaded element 820 may be pressed, glued, welded or otherwise affixed to one end of the guide housing 804. The threaded element 820 is configured to threadingly receive a flare fitting (not shown) and is operable to hold the flare fitting in a desired position during a repair operation. The threaded element 820 includes a cylindrical insert 822 having internal threads formed in an inner wall 824 thereof and an outer wall 826 sized to engage the internal bore of the guide aperture 806 of the tool head guide 802. A flange 828 extends outward from the outer wall 826 at one end of the threaded element 820. A rim 830 is formed on an inner portion of the flange 828. The rim 830 can form a locating interface region of the threaded element 820 with one of the first or second ends 808, 810 of the tool head guide housing 804.

The repair tool 800 includes a surfacing tool 840 configured to grind, polish, repair or otherwise form a finished seal surface on a flare fitting. The surfacing tool 840 includes a tool head 842 configured to slide in an axial direction through the guide aperture 806 of the guide housing 804. The tool head 842 can independently rotate within the guide aperture 806 of the guide housing 804 while either moving or fixed in an axial position within the guide housing 804. The tool head 842 includes a cylindrical outer wall 844 extending between a first end 846 and a second end 848. A shaft 850 extends from the tool head 842 to form a drive input to the tool head 842. The shaft 850 can be rotated via hand operation or an electrical or pneumatic rotary tool (not shown). The shaft 850 is configured transmit an axial and/or a rotational movement to the tool head 842. A gripping feature 852 such as a flat, a recession or a protrusion and the like may be formed with the shaft 850 to permit means for torque transmission from a rotary tool or a hand grip.

A reverse flare working surface 860 generally shaped as an internal cone like feature is formed proximate the first end 846 of the tool head 842. The working surface 860 is configured to grind, polish, form or otherwise repair a flared interface end sealing surface of a 1 inch flare fitting. A flare angle Ø of the working surface 860 can be any standard or nonstandard angle that is configured to engage the seal surface of the flare fitting. By way of example and not limitation, the angle Ø can be 74 degrees, 45 degrees, 60 degrees or other desired angle. In some forms, the working surface 860 can be made from a material that is the same as other portions of the tool head 842. In other forms, the working surface 860 can be made from a material that is different from other portions of the tool head 842. Further, the working surface 860 can include a material coating to increase the grinding effectiveness of the tool head 842. The material coating can include natural or man-made constituents. In some forms, the material coating can include diamond particles or other abrasive substances to facilitate material removal of damaged portions of the seal surface of the flare fitting.

Figure 20:
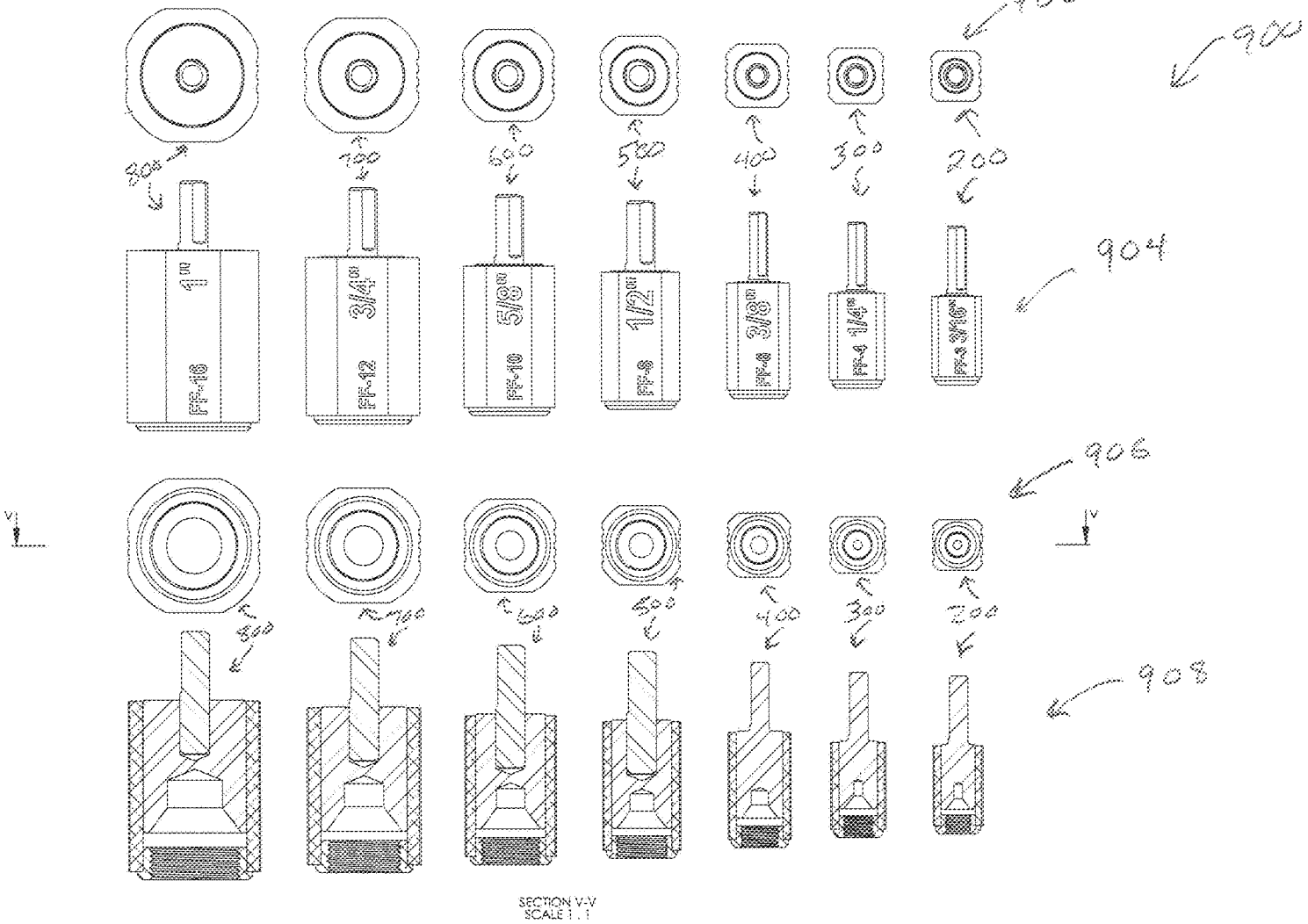
FIG. 20 shows cross -sectional views for a plurality of repair tools shown in FIGS. 13-19.

FIG. 20 illustrates a Kit 900 with a plurality of repair tools of various sizes depicted with a surfacing tool positioned within a corresponding guide housing. A first row 902 row illustrates a first end view of the repair tools. A second row 904 illustrates a side view of the repair tools. A third row 906 row illustrates a second end view of the repair tools. A fourth row 908 row illustrates a cross sectional view of the repair tools.

Figure 21:
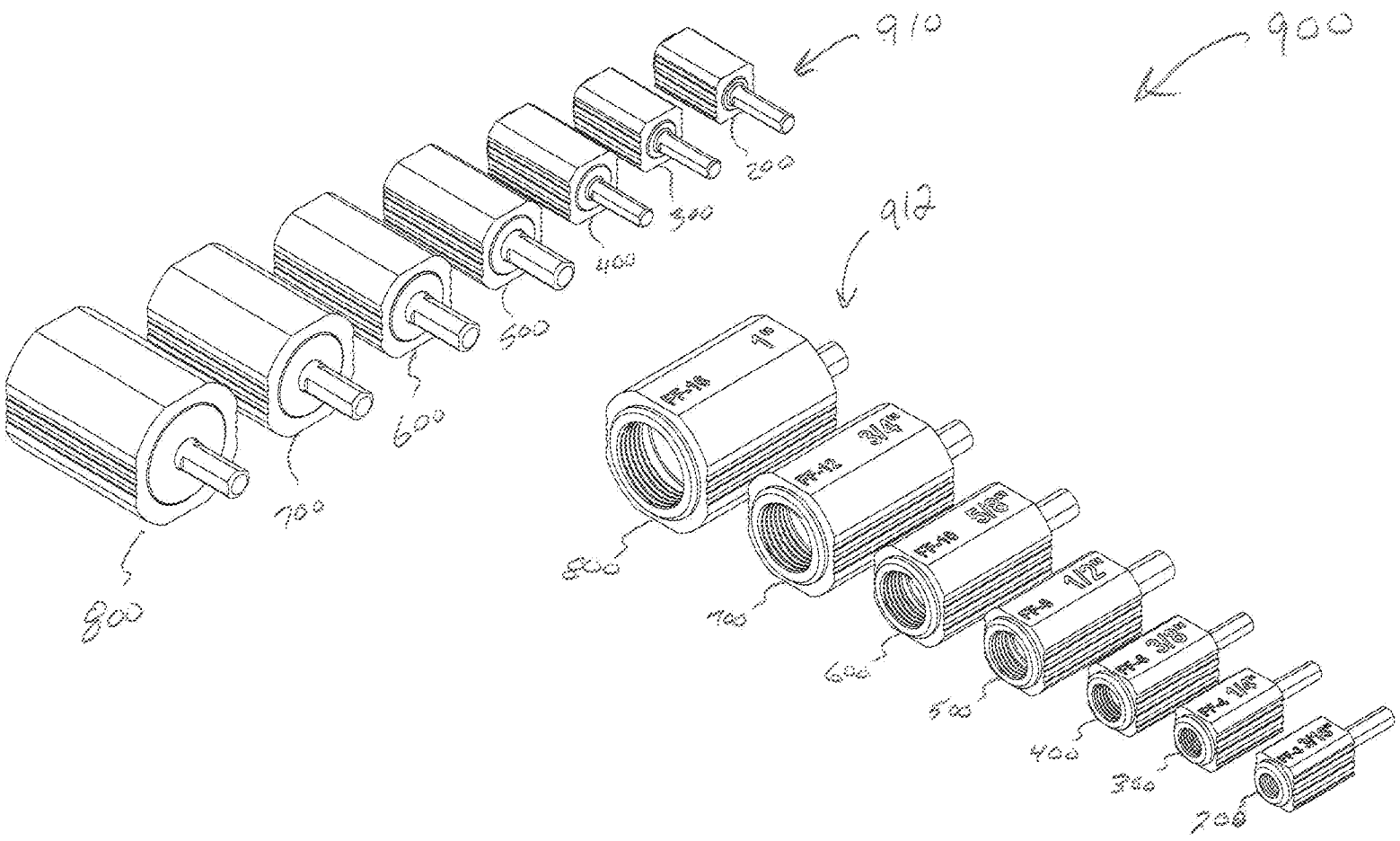
FIG. 21 shows perspective views for a plurality of repair tools shown in FIGS. 13-19.

FIG. 21 illustrates the Kit 900 with a plurality repair tools having a surfacing tool positioned within a corresponding guide housing. A first row 910 row illustrates a first perspective view of the repair tools and a second row 912 illustrates another perspective view of the repair tools for the Kit 900.

In operation a flare fitting is threaded into a threaded element of a guide housing sized for the flare fitting. A surfacing or grinding tool is inserted into a guide aperture and slid axially from one end toward the other end until the working surface of the tool head engages with the sealing surface of a flare fitting. A shaft extending from the tool head is rotated in a clockwise and/or counter clockwise direction at desired rotational speed and with a desired axial force sufficient to grind and refinish the fluid seal surface of the fitting. The seal surface of the flare fitting is ground, polished or otherwise refinished until the desired surface finish is obtained and thus enable a fluid tight seal to be formed between the fitting and a mating conduit.

In one aspect the present disclosure includes a surfacing tool comprising: a tool head having an external cylindrical shape with a reverse flare working surface positioned proximate a first end thereof; a shaft extending from an opposing second end of the tool head; a tool head guide including an internal bore sized to receive the tool head therein, the internal bore configured to engage an outer surface of the tool head and align the reverse flare working surface in a desired orientation; and a threaded portion positioned at one end of the tool head guide, the threaded portion configured to threadingly receive a threaded flare fitting.

In refining aspects the tool head guide includes a cylindrical outer wall; a plurality of planer outer walls; wherein at least one of the planer outer walls include a plurality of ribs extending outward therefrom; the ribs are configured to provide a grip feature; the threaded portion of the tool head guide and the tool head guide are separate components; the threaded portion of the tool head guide is defined by a cylindrical insert having an outer wall configured to engage the internal bore of the tool head guide; the threaded portion includes a flange extending from the cylindrical insert; the flange of the threaded portion engages with an end wall of the tool head guide; a flare fitting is threadingly engaged with the threaded portion of the tool head guide; the shaft includes a torque transmission feature extending along an external length thereof; the shaft is connectable to a rotary tool; the rotary tool includes one of an electric or a pneumatic motor drive; and the rotary tool is operable for rotating the tool head within the tool head guide while engaged with the sealing surface of the flare fitting.

Another aspect of the present disclosure includes a kit for repairing seal surfaces for a plurality of different fittings, the kit comprising: a plurality of differently sized tool head guides, each tool head guide including an internal cylindrical bore with a threaded element positioned at one end thereof; a plurality of differently sized tool heads, each tool head sized to slide and rotate within the internal cylindrical bore of a correspondingly sized tool head guide; and a tool head having an external cylindrical shape with a reverse flare working surface positioned proximate a first end thereof.

In refining aspects, the kit further comprises a shaft extending from an opposing second end of the tool head; wherein the shaft is connectable to a rotary tool; the internal bore of each tool head guide is configured to engage an outer surface of a corresponding tool head and position the reverse flare working surface into alignment with the seal surface of one of the plurality of fittings; each of the threaded elements is configured to threadingly receive a threaded flare fitting; the reverse flare working surface of each of the tool heads includes a material coating adapted to remove material from the seal surface of a corresponding fitting; the tool head guide includes a plurality of planer outer walls; at least one of the planer outer walls include a plurality of ribs extending outwardly therefrom; the threaded element of each of the tool head guides is defined by a cylindrical insert having an outer wall configured to engage with the internal bore of a corresponding tool head guide; each of the threaded elements includes a flange extending from the cylindrical insert; and each of the flanges of the threaded elements is configured to engage with an end wall of a corresponding tool head guide.

Another aspect of the present disclosure includes a method comprising: repairing a seal surface of a flare fitting with a repair tool selected from a kit having a plurality of differently sized repair tools; wherein each repair tool includes: a tool head having an external cylindrical shape with a reverse flare working surface positioned proximate one end thereof; a shaft extending from an opposing end of the tool head; a tool head guide including an internal bore sized to receive the tool head therein, the internal bore configured to engage an outer surface of the tool head and align the reverse flare working surface in a desired orientation; and a threaded portion positioned at one end of the tool head guide.

In refining aspects, the method for repairing includes threading the flare fitting into the threaded portion of the tool head guide; sliding the tool head through the internal bore of the tool head guide; contacting the sealing surface of the flare fitting with the working surface of the tool head; and rotating the tool head in a first direction and/or a second direction until a desired surface finish is formed on the sealing surface of the flare fitting.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A surfacing tool comprising:

a tool head having an external cylindrical shape with a reverse flare working surface positioned proximate a first end thereof, the reverse flare working surface being configured to grind, polish, form or repair a sealing surface of a male flare fitting;

a shaft extending from an opposing second end of the tool head;

a tool head guide including an internal bore sized to receive the tool head therein, the internal bore configured to engage an outer surface of the tool head and align the reverse flare working surface in a desired orientation; and a threaded portion positioned at one end of the tool head guide, the threaded portion configured to threadingly receive a threaded male flare fitting.

2. The surfacing tool of claim 1, wherein the tool head guide includes a cylindrical outer wall.

3. The surfacing tool of claim 1, wherein the tool head guide includes a plurality of planer outer walls.

4. The surfacing tool of claim 3, wherein at least one of the planer outer walls include a plurality of ribs extending outward therefrom.

5. The surfacing tool of claim 4, wherein the ribs are configured to provide a grip feature.

6. The surfacing tool of claim 1, wherein the threaded portion of the tool head guide and the tool head guide are separate components.

7. The surfacing tool of claim 1, wherein the threaded portion of the tool head guide is defined by a cylindrical insert having an outer wall configured to engage the internal bore of the tool head guide.

8. The surfacing tool of claim 7, wherein the threaded portion includes a flange extending from the cylindrical insert.

9. The surfacing tool of claim 8, wherein the flange of the threaded portion engages with an end wall of the tool head guide.

10. The surfacing tool of claim 1, wherein the threaded portion of the tool head guide is constructed to threadingly receive and engage the threaded male flare fitting.

11. The surfacing tool of claim 1, wherein the shaft includes a torque transmission feature extending along an external length thereof.

12. The surfacing tool of claim 1, wherein the shaft is connectable to a rotary tool.

13. The surfacing tool of claim 12, wherein the rotary tool includes one of an electric or a pneumatic motor drive.

14. The surfacing tool of claim 12, wherein the rotary tool is operable for rotating the tool head within the tool head guide while engaged with the sealing surface of the male flare fitting.

15. A kit for repairing seal surfaces for a plurality of differently sized male flare fittings, the kit comprising:

a plurality of differently sized tool head guides, each tool head guide of the plurality of differently sized tool head guides including an internal cylindrical bore with a threaded element positioned at one end thereof, each tool head guide of the plurality of differently sized tool head guides having a size associated with a corresponding fitting of the plurality of differently sized male flare fittings;

a plurality of differently sized tool heads, each tool head of the plurality of differently sized tool heads sized to slide and rotate within the internal cylindrical bore of a correspondingly sized tool head guide, each tool head of the plurality of differently sized tool heads having an external cylindrical shape with a reverse flare working surface positioned proximate to a first end thereof, the reverse flare working surface being configured to grind, polish, form or repair a sealing surface of a male flare fitting of the differently sized male flare fittings.

16. The kit of claim 15 further comprising a shaft extending from an opposing second end of the tool head.

17. The kit of claim 16, wherein the shaft is connectable to a rotary tool.

18. The kit of claim 15, wherein the internal bore of each tool head guide is configured to engage an outer surface of a corresponding tool head and position the reverse flare working surface into alignment with the seal surface of a corresponding one of the male flare fittings of the plurality of differently sized male flare fittings.

19. The kit of claim 15, wherein each male flare fitting of the plurality of differently sized male flare fittings is threaded; and wherein each of the threaded elements is configured to threadingly receive a threaded male flare fitting of the plurality of differently sized male flare fittings.

20. The kit of claim 15, wherein the reverse flare working surface of each of the tool heads includes a material coating adapted to remove material from the seal surface of a corresponding male flare fitting of the plurality of differently sized male flare fittings.

21. The kit of claim 15, wherein the tool head guide includes a plurality of planer outer walls.

22. The kit of claim 21, wherein at least one of the planer outer walls include a plurality of ribs extending outwardly therefrom.

23. The kit of claim 15, wherein the threaded element of each of the tool head guides is defined by a cylindrical insert having an outer wall configured to engage with the internal bore of a corresponding tool head guide.

24. The kit of claim 23, wherein each of the threaded elements includes a flange extending from the cylindrical insert.

25. The kit of claim 24, wherein each of the flanges of the threaded elements is configured to engage with an end wall of a corresponding tool head guide.

26. A method comprising:

repairing a seal surface of a male flare fitting with a repair tool selected from a kit having a plurality of differently sized repair tools;

wherein each repair tool includes:

a tool head having an external cylindrical shape with a reverse flare working surface positioned proximate one end thereof, the reverse flare working surface being configured to grind, polish, form or repair a sealing surface of a male flare fitting;

a shaft extending from an opposing end of the tool head;

a tool head guide including an internal bore sized to receive the tool head therein, the internal bore configured to engage an outer surface of the tool head and align the reverse flare working surface in a desired orientation; and a threaded portion positioned at one end of the tool head guide.

27. The method of claim 26, wherein the repairing includes:

threading the male flare fitting into the threaded portion of the tool head guide;

sliding the tool head through the internal bore of the tool head guide;

contacting the sealing surface of the male flare fitting with the reverse flare working surface of the tool head; and rotating the tool head in a first direction and/or a second direction until a desired surface finish is formed on the sealing surface of the male flare fitting.

* * * * *